US006014530A

United States Patent [19]

Tsunemi

[11] Patent Number: 6,014,530

[45] Date of Patent: Jan. 11, 2000

[54] IMAGE FORMING APPARATUS HAVING AN IMPROVED PHOTOSENSITIVE DRUM CLEANING SYSTEM

[75] Inventor: Takeo Tsunemi, Susono, Japan

[73] Assignee: Canon Kabushiki Kaisha, Tokyo, Japan

[21] Appl. No.: 09/026,427

[22] Filed: Feb. 19, 1998

[30] Foreign Application Priority Data

Feb. 19, 1997 [JP] Japan ..... 9-34666

[51] Int. Cl.[7] ..... G03G 15/08; G03G 21/00

[52] U.S. Cl. ..... 399/53; 399/50; 399/55; 399/26; 399/350

[58] Field of Search ..... 399/49, 55, 51, 399/350, 351, 50, 26, 53

[56] References Cited

U.S. PATENT DOCUMENTS 5,481,337 1/1996 Tsuchiya et al. .

5,532,794 7/1996 Tokuyama et al. .

5,555,076 9/1996 Yoshiyama .

5,678,131 10/1997 Alexandrovich ..... 399/58

*Primary Examiner*—Richard Moses

*Attorney, Agent, or Firm*—Fitzpatrick, Cella, Harper & Scinto

[57] ABSTRACT

This invention relates to a image forming apparatus comprising an image carrier, charging means, image exposing measuring means, surface correction toner image forming means for forming a toner image extending in parallel to a direction of a rotation axis of the image carrier at a non-image area on the surface of the image carrier and a controller for changing a formation condition of the surface correction toner image formed parallel to the direction of the rotation axis of the image carrier at the non-image area on the surface of the image carrier by the surface correction toner image forming means, according to the surface roughness or the physical property value reflecting the surface roughness of the image carrier measured by the measuring means.

45 Claims, 12 Drawing Sheets

IMAGE FORMING APPARATUS HAVING AN IMPROVED PHOTOSENSITIVE DRUM CLEANING SYSTEM

BACKGROUND OF THE INVENTION

1. Field of the Invention

This invention relates to an electrophotographic image forming apparatus, e.g., such as a photocopier, a laser printer, and the like.

2. Description of Related Art

Image forming apparatuses of this type have been known as electrophotographic photocopiers and laser printers, in which an electrostatic latent image is formed on an image carrier surface by exposing image light on the uniformly charged image carrier surface in accordance with an image scanned from an original or inputted as an image signal and in which a toner image is fixed and outputted after the electrostatic latent image is developed by a developer to form the toner image and the toner image is transferred onto a transfer material.

The residual toner remaining on the image carrier surface after the toner image is transferred is removed by a cleaning means and will be prepared for subsequent image forming processes. As a cleaning means, what is widely used is a plate shaped elastic member made in contact with the image carrier surface to wipe the residual toner off. The plate shaped elastic member is referred to as a cleaning blade, which is attached to orient in the opposite direction to a rotation direction of the image carrier, or namely in the counter direction, so as to wipe the residual toner off efficiently.

FIG. 16(*a*) is an illustration showing an essential structural portion of the image carrier and a cleaning means. In FIG. 16(*a*), a photosensitive drum 101 serving as an image carrier rotates in a direction of an arrow a, and the cleaning unit 102 is mounted in a counter direction in opposition to the rotation direction of the photosensitive drum 101. The cleaning unit 102 includes a cleaning blade 102*a* for wiping residual toner on a surface of photosensitive drum 101 by contacting with the drum surface, and a waste toner container 102*b* for collecting the residual toner as waste toner with the drum surface wiped by the cleaning blade 102*a*.

With the cleaning unit described above, the cleaning blade 102*a* may turn to extend in the rotation direction of the photosensitive drum 101 as shown in FIG. 16(*b*) due to contact friction between the cleaning blade 102*a* and the photosensitive drum 101. If the cleaning blade 102*a* is flipped over or turned over, the photosensitive drum 101 is unable to wipe off the residual toner on the surface of the photosensitive drum 101, so that extra toner may remain on the surface of the photosensitive drum 101 when an image is formed, thereby likely causing image defects.

Once the cleaning blade 102*a* is turned over, the blade's edge in contact with the drum surface likely sustains fine scratches even if the turnover of the cleaning blade 102*a* is corrected upon rotating the photosensitive drum 101 in the reverse direction to the arrow a in FIG. 16(*b*) or taking turnover of cleaning blade 102*a* is corrected upon photosensitive drum 101 out of the apparatus body, thereby causing some cleaning failures that the blade edge is partially unable to clean the drum surface adequately, and thereby impairing image quality by creating stripes extending in a conveyance direction on an image formed on a transfer material. Moreover, since excessive bending force applies to the cleaning blade 102*a*, permanent stresses may remain in the cleaning blade 102*a* itself, so that the cleaning blade 102*a* easily and frequently turns over, and so that partial cleaning failures may occur because the cleaning blade 102*a* contacts to the surface of the photosensitive drum 101 with uneven contact force that may vary depending on the location of the blade.

It has been known that such a turnover of the cleaning blade 102*a* frequently occurs when the photosensitive drum 101 is new and still not much used. A new photosensitive drum 101 has a smoother surface roughness, thereby enlarging the contact area to the cleaning blade 102*a*, and giving greater contact friction to the cleaning blade 102*a*. The cleaning blade 102*a* can turn more frequently at side ends of the blade rather than the center of the blade, and the entire area may turn over initially from a side end as the blade is being used while the blade end only has been turned over.

As a way to prevent the cleaning blade 102*a* from turning over, conceivable methods are to reduce contact friction in applying lubricant in advance to edge portions of the cleaning blade 102*a* to which the photosensitive drum 101 contacts; to reduce contact friction by abrading the surface of the photosensitive drum 101 with a fine sandpaper to make larger the surface roughness of the photosensitive drum 101 in advance. However, those methods require extra processes to apply a lubricant at the edge portion of the cleaning blade 102*a* or to abrade the surface of the photosensitive drum 101 with the sandpaper, and therefore, not only those methods invite increased costs but also those methods will not always bring adequate effects in terms of a way to prevent the cleaning blade from turning over.

It has been known that a resin as an original material for forming toner has a glass transition temperature around 40 to 80 Celsius degrees. If friction force generated between the surface of the photosensitive drum 101 and the cleaning blade 102*a* becomes too much, the edge shape of the cleaning blade 102*a* is transformed and thereby reduces capability of wiping residual toner. Furthermore, heat generated from friction between the cleaning blade 102*a* and the surface of the photosensitive drum 101 may increase as to raise the temperature at a boundary between the edge of the cleaning blade 102*a* and the surface of the photosensitive drum 101 up to around 40 to 80 Celsius degrees, thereby softening the toner located at the boundary. The softened toner is cooled upon reception of pressure onto the surface of the photosensitive drum 101, and a sticking phenomenon may occur in which the toner sticks on the surface of the photosensitive drum 101 in a semipermanent fashion. Because the surface of the photosensitive drum 101 is constituted of a material having a photosensitive property, the original photosensitive function of the photosensitive drum 101 may be impaired when the toner, an insulating material, is stuck on the surface of the photosensitive drum 101, and the photosensitive drum 101 may be therefore subject to a fatal malfunction.

SUMMARY OF THE INVENTION

It is an object of the invention to provide an image forming apparatus for preventing cleaning means or a cleaning blade from turning over and preventing toner from sticking on an image carrier by preventing friction force exerted between the surface of the image carrier and the cleaning means from becoming excessive, as to create high-quality images, to solve the problems above.

During research and development of this art, we have leaned that a friction coefficient between the surface of the image carrier and the cleaning means (cleaning blade)

remains relatively small while a very small amount of toner is continuously supplied to a cleaning portion where the surface of the image carrier is in contact with the cleaning means. The reason is that the toner works as a lubricant for lubricating the image carrier and the cleaning means if a very small amount of toner exists at the boundary of the cleaning portion where the surface of the image carrier is in contact with the cleaning means.

A representative embodiment of the invention to accomplish the foregoing object is an image forming apparatus including: an image carrier rotatively driven; charging means for uniformly charging a surface of the image carrier; image exposing means for forming an electrostatic latent image on the surface of the image carrier on which the charging means uniformly charges, by exposing the surface according to image information; developing means for developing a toner image from the electrostatic latent image formed by the image exposing means; transferring means for transferring the toner image formed on the surface of the image carrier by the developing means onto a transfer material; cleaning means for contacting to the surface of the image carrier to remove residual toner remaining on the surface of the image carrier after the toner image formed on the surface of the image carrier is transferred onto the transfer material by the transferring means; measuring means for measuring a surface roughness or physical property value reflecting the surface roughness of the image carrier; surface correction toner image forming means for forming a toner image extending in parallel to a direction of a rotation axis of the image carrier at a non-image area where no image is formed on the surface of the image carrier; and a controller for changing a formation condition of the surface correction toner image formed parallel to the direction of the rotation axis of the image carrier at the non-image area on the surface of the image carrier by the surface correction toner image forming means, according to the surface roughness or the physical property value reflecting the surface roughness of the image carrier measured by the measuring means.

According to the embodiment above, the controller changes, according to the surface roughness or the physical property value reflecting the surface roughness of the image carrier measured by the measuring means, the formation condition of the surface correction toner image formed parallel to the direction of the rotation axis of the image carrier at the non-image area on the surface of the image carrier by the surface correction toner image forming means. When the surface roughness of the image carrier is smaller (i.e., when the contact friction is large), the toner amount for surface correction is made larger to supply a very small amount of toner at a boundary of a cleaning portion located between the image carrier and the cleaning means (cleaning blade) in contact with the surface of the image carrier. The supplied toner operates as a lubricant for lubricating the cleaning means and the image carrier, and therefore, an image forming apparatus can be provided having capability of obtaining good images upon preventing the cleaning blade from turning over and preventing the toner from sticking on the image carrier, by preventing the friction force between the surface of the image carrier and the cleaning means from becoming excessive and by suppressing generation of frictional heats.

The measuring means is constituted to measure the film thickness of a photosensitive layer of the image carrier or physical property value reflecting the film thickness, which are serving as a physical property value reflecting the surface roughness of the image carrier. When the film thickness of the photosensitive layer of the image carrier is thick, or namely, when the image carrier is still not much used and at an initial stage of use with a smaller surface roughness of the image carrier and when the friction resistance is large between the surface of the image carrier and the cleaning means (cleaning blade), the toner amount for surface correction is made larger, and an image forming apparatus can be provided having capability of obtaining good images upon preventing the cleaning blade from turning over and preventing the toner from sticking on the image carrier, by preventing the friction force between the surface of the image carrier and the cleaning means from becoming excessive and by suppressing generation of frictional heats.

The formation condition of the surface correction toner image formed parallel to the direction of the rotation axis of the image carrier at a non-image area where no image is formed on the surface of the image carrier by the surface correction toner image forming means is selected from any one or more of formation frequency of the surface correction toner image, length of the surface correction toner image in the circumferential direction of the surface of the image carrier, length of the surface correction toner image in a rotation axis direction of the image carrier, and density of the surface correction toner image. An optimum toner amount can be supplied corresponding to the surface roughness of the image carrier, and thereby, the image forming apparatus can be provided having capability of obtaining good images upon preventing the cleaning blade from turning over and preventing the toner from sticking on the image carrier. Moreover, the image forming apparatus can suppress excessive toner supply, so that the apparatus can enjoy economical advantages by reducing unnecessary toner consumption.

Supplying a larger toner amount at an end or ends of the cleaning blade than that at the center of the blade can prevent the end or ends of the cleaning blade from turning over. The controller changes, by controlling a voltage contrast between a voltage at the surface of the image carrier and a voltage at a surface of a developer carrier of the developing means at a prescribed time, the formation condition of the surface correction toner image created by the surface correction toner image forming means at the non-image area on the surface of the image carrier. The image forming apparatus can change the surface correction toner amount much more than a preexisting device, and therefore can reduce the number of parts and costs.

The formation condition of the toner image formed parallel to the direction of the rotation axis of the image carrier at the non-image area on the surface of the image carrier by the surface correction toner image forming means is selected from any one or more of developing bias applying to the developing means, charging bias applying to the charging means, and exposure amount by the image exposing means (light energy density per unit area and light emitting period or timing). A toner supply amount and timing for surface correction can be controlled to be optimum values, and thereby, the image forming apparatus can be provided having capability of obtaining good images upon preventing the cleaning blade from turning over and preventing the toner from sticking on the image carrier.

DETAILED DESCRIPTION OF PREFERRED EMBODIMENTS

Figure 1:
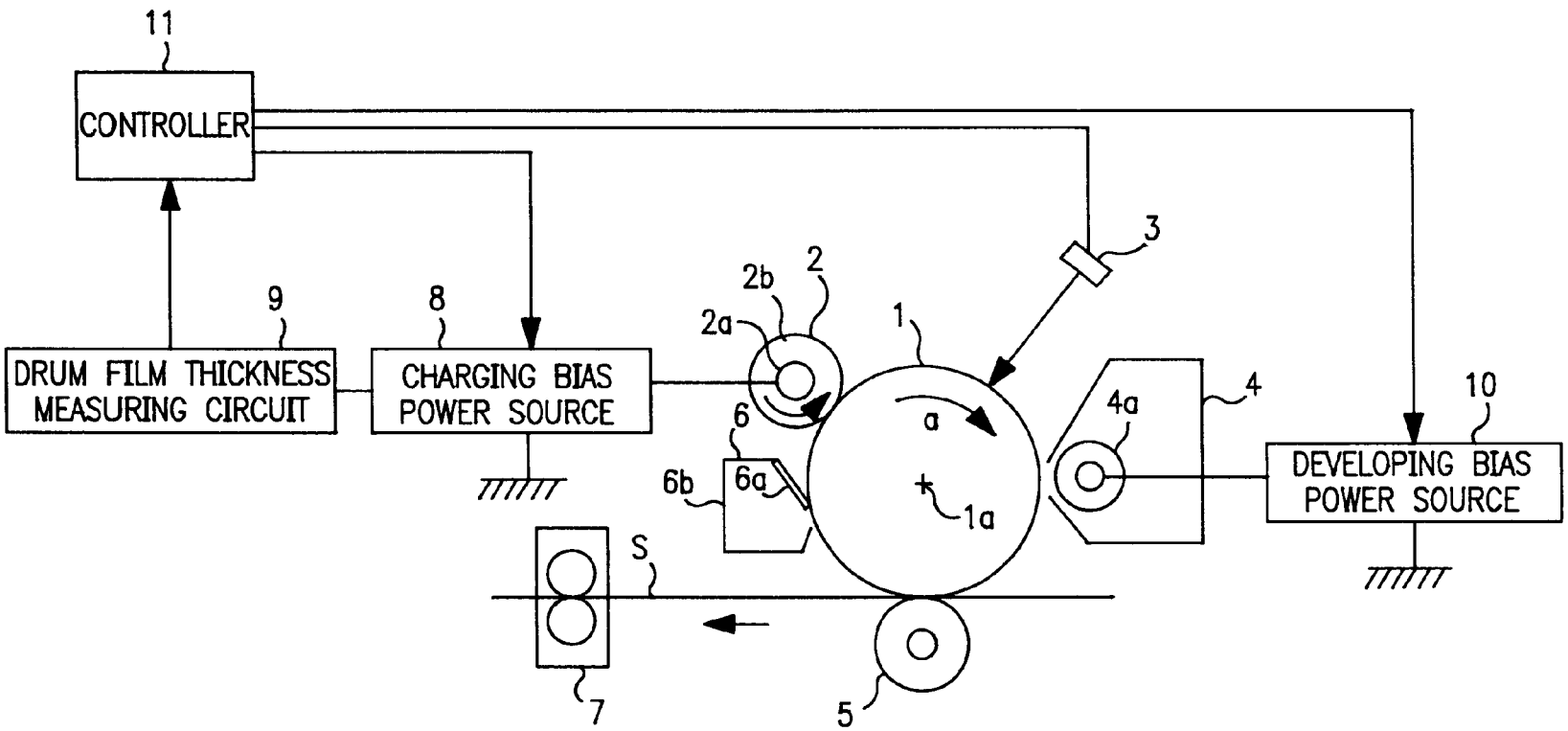
FIG. 1 is a schematic block diagram showing a structure of an image/forming apparatus according to the invention.
Figure 2:
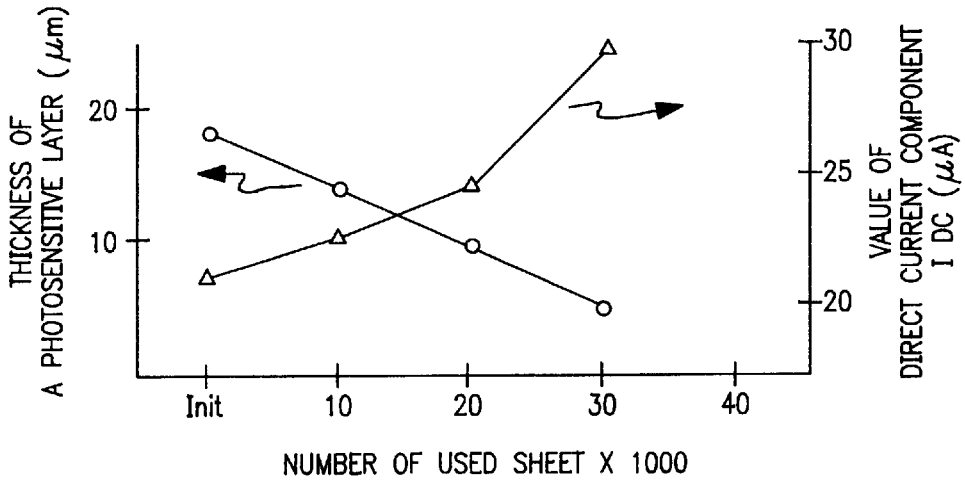
FIG. 2 is a diagram showing relation among the number of used sheets (endurable sheet number) in the image forming apparatus, thickness of a photosensitive layer of an image carrier, and current value of direct current component for detection in a charging bias.
Figure 3:
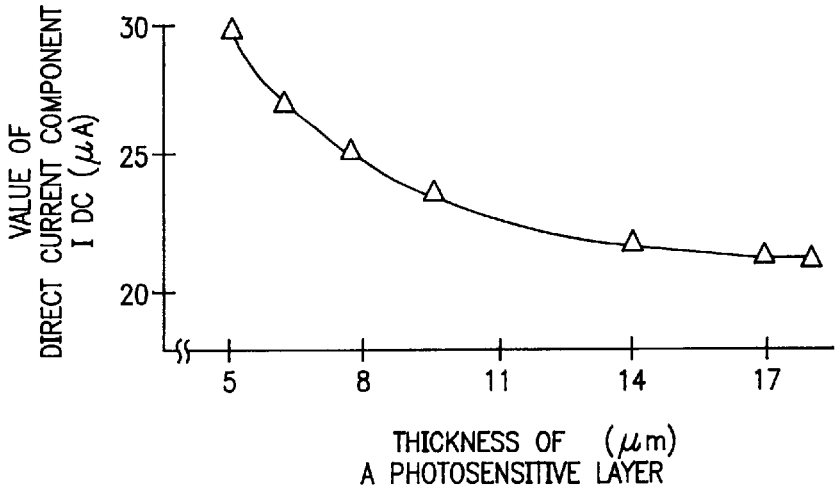
FIG. 3 is a diagram showing relation between thickness of the photosensitive layer of the image carrier and current value of direct current component for detection in the charging bias.
Figure 4:
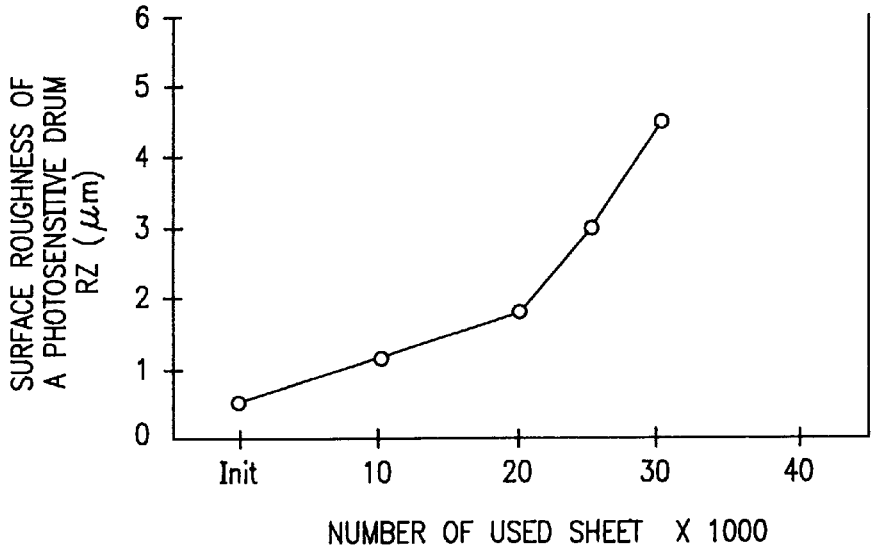
FIG. 4 is a diagram showing relation between the number of used sheets (endurable sheet number) in the image forming apparatus and surface roughness of the image carrier.
Figure 5:
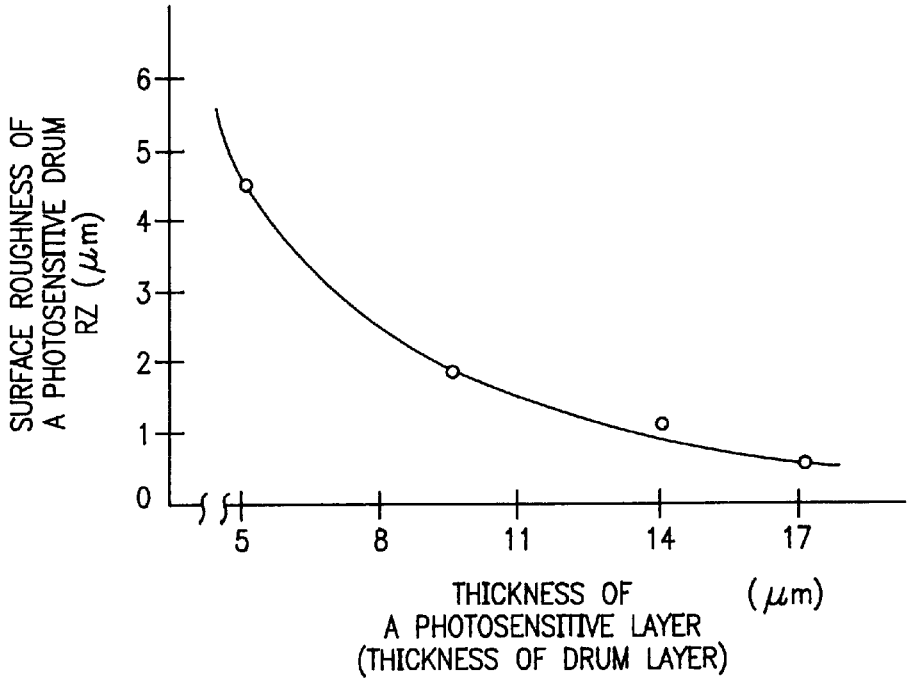
FIG. 5 is a diagram showing relation between thickness of the photosensitive layer of the image carrier and surface roughness of the image carrier.
Figure 6:
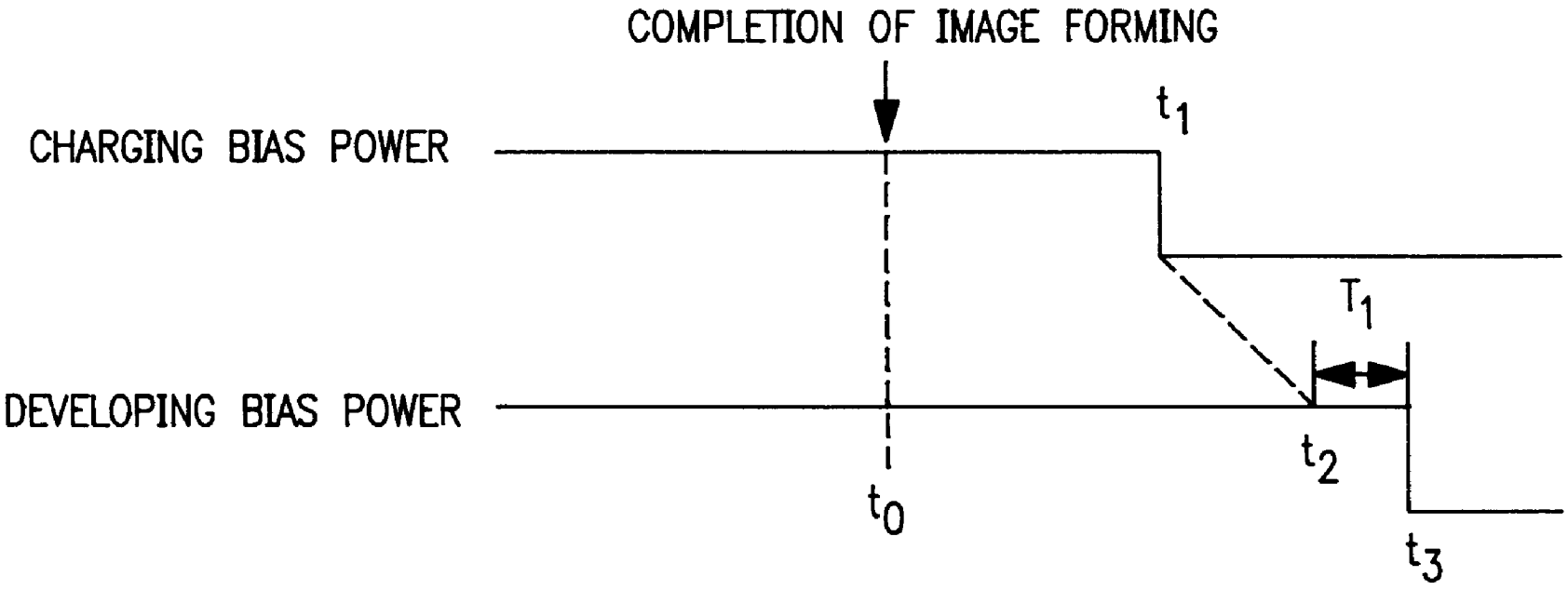
FIG. 6 is a time chart illustrating formation operation of a surface correction toner image of a first embodiment.
Figure 7:
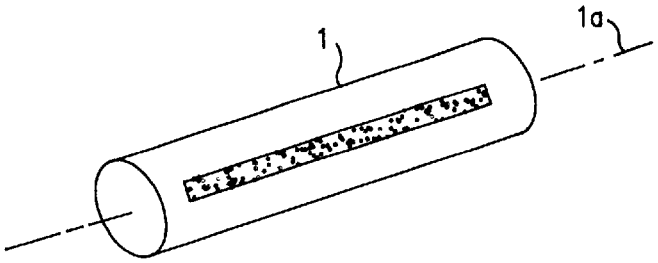
FIG. 7 is an illustration showing a surface correction toner image formed on the surface of an image carrier in the first embodiment of the image forming apparatus according to the invention.

Referring to the drawings, an image forming apparatus of a first embodiment of the invention will be described in detail. FIG. 1 is a schematic block diagram showing a structure of an image forming apparatus according to the invention; FIG. 2 is a diagram showing relation among the number of used sheets (durable sheet number) in the image forming apparatus, thickness of a photosensitive layer of an image carrier, and current value of direct current component for detection in a charging bias; FIG. 3 is a diagram showing relation between thickness of the photosensitive layer of the image carrier and current value of direct current component for detection in the charging bias; FIG. 4 is a diagram showing relation between the number of used sheets (durable sheet number) in the image forming apparatus and surface roughness of the image carrier; FIG. 5 is a diagram showing relation between thickness of the photosensitive layer of the image carrier and surface roughness of the image carrier; FIG. 6 is a time chart illustrating formation operation of a surface correction toner image of a first embodiment; FIG. 7 is an illustration showing a surface correction toner image formed on the surface of an image carrier in the first embodiment of the image forming apparatus according to the invention The image forming apparatus according to the invention is applicable to an image forming apparatus for forming images by forming electrostatic latent images on an image carrier, e.g., such as a photosensitive body, or dielectric body, etc., corresponding to image information signals in using an electrophotographic method, or an electrostatic recording method, etc. and then by visualizing the electrostatic latent images using a developer (toner) with a developing means.

Referring to FIGS. 1 to 7, an embodiment is described in which the invention applies to an electrophotographic image forming apparatus as one form of the image forming apparatus of the invention. First, referring to FIG. 1, the entire constitution of the image forming apparatus is described.

In FIG. 1, at an outer circumference of an electrophotographic photosensitive drum 1 serving as an image carrier rotatable by a drive unit, not shown, in an arrow direction and in FIG. 1 around a rotation axis 1*a*, arranged are a charging roller 2 serving as charging means for uniformly charging the surface of the photosensitive drum 1, an image exposing means 3 for forming electrostatic latent images by exposing the surface of the photosensitive drum 1, which is uniformly charged by the charging roller 2, with light corresponding to image information, a developing means 4 for visualizing toner images from the electrostatic latent images formed by the image exposing means 3, a transfer roller 5 serving as transferring means for transferring the toner images formed on the surface of the photosensitive drum 1 by the developing means 4 onto a transfer material S made of paper or synthetic resin or the like, and a cleaning means 6 having a cleaning blade 6*a* in contact with the surface of the photosensitive drum 1 to remove residual toner remaining on the surface of the photosensitive drum 1 after the toner image formed on the surface of the photosensitive drum 1 by the transfer roller 5 is transferred onto the transfer material S. A fixing means 7 is disposed on a transfer material's downstream side with respect to the photosensitive drum 1 for fixing the toner image transferred on the transfer material S.

A conveying means, not shown, feeds the transfer material S at a nip portion between the photosensitive drum 1 and the transfer roller 5. Meanwhile, an electrostatic latent image is formed on the surface of the photosensitive drum 1 by emitting, by means of the image exposing means 3, image light corresponding to an original image or inputted image signal onto the surface of the photosensitive drum 1, on which is uniformly charged by the charging roller 2. The electrostatic latent image is developed by the developing means 4 to a toner image, and after the toner image is transferred onto the transfer material S carried synchronously with rotational movement of the photosensitive drum 1, the material is delivered out of the apparatus body upon fixed with heat and pressure by means of the fixing means 7.

The residual toner remaining on the surface of the photosensitive drum 1 after completion of the transfer process of the toner image is removed by the cleaning means 6, and the apparatus prepares for the subsequent image formation processes. The cleaning means 6 has the cleaning blade 6*a* made of a plate shaped elastic member disposed as to extend in an axial direction of the rotation axis 1*a* of the photosensitive drum 1. To remove residual toner with good efficiency, the cleaning means 6 is mounted, in contact with the surface of the photosensitive drum 1, as to extend in a so called counter direction arranged in a direction opposite to the rotational direction (direction of the arrow a in FIG. 1) of the photosensitive drum 1. Rotation of the photosensitive drum 1 in the arrow a in FIG. 1 renders the residual toner which is wiped by the cleaning blade 6*a* contained in a waste toner container 6*b* as waste toner.

The charging means, a corona charger, using corona discharge is widely used. From increased concerns about environmental problems these days, however, a charging roller capable of significantly reducing ozone amounts produced during corona discharges is getting used as a charging roller 2 as charging means or a developing roller 5 as transfer means, particularly in small printers and low speed photocopiers. The charging roller 2 has a rubber layer 2*b* having a predetermined electrical resistance and elasticity placed at an outer circumference of a core metal 2*a* made of a metal and can reduce the total current of a bias and a bias voltage in comparison with the corona discharge. As a material for forming the rubber layer 2*b*, used is epichlorohydrin rubber, nitrile rubber, or urethane rubber, etc., mixed and dispersed with various conductive substances and formed to have a prescribed resistance. In this embodiment, a charging roller having an electrical resistance of the rubber layer 2*b* of about 106 Ohm (when a voltage of 200 volts is applied), a hardness of about 60 degrees (Ascar C, 500 g·load), a diameter of 16 centimeters, and a length of 30 centimeters is used.

The developing means 4 makes a developer (toner) carried by a developer carrier cling to an electrostatic latent image formed on the surface of the photosensitive drum 1 by applying a bias voltage including at least a direct current component to a developer carrier such as a developing sleeve 4*a* placed as to be opposed to the photosensitive drum 1 at a developing position of the means 4 and visualizes the electrostatic latent image as a toner image.

In order for charging the surface of the photosensitive drum 1 at a fixed potential, this embodiment uses a charging bias power source 8 for applying, to the charging roller 2, a bias in which a direct current is superimposed to an alternating current. The component of the alternating current is a sine wave of frequency, about 1 kHz and voltage, about 2 kV peak to peak, and the component of the direct current is about −700 volts.

A drum film thickness measuring circuit 9 serving as measuring means for measuring a film thickness of the photosensitive layer of the photosensitive drum 1 or physical property value reflecting the film thickness as a physical property value reflecting the surface roughness of the image carrier is connected to the charging bias power source 8. The drum film thickness measuring circuit 9 measures the current value of the direct component supplied to the surface of the photosensitive drum 1, and the apparatus actually measures the film thickness of the photosensitive layer by a method as described below or presumes the thickness from some measured data (see FIG. 3).

As the image forming apparatus is used, the surface of the photosensitive drum 1 is damaged by discharges from the charging roller 2 and the transfer roller 5 and is also made rougher by sliding friction by cleaning blade 6*a* for wiping residual toner remaining on the surface of the photosensitive drum 1, thereby gradually grinding the surface.

With such an image forming apparatus as described above, an endurance test is conducted, and the test result is shown in FIG. 2 in which film thickness (micrometer) of the photosensitive film of the photosensitive drum 1 and changes of direct current component current value I DC (microampere) are measured. The film thickness is separately measured by a film thickness meter using eddy currents, and the direct current component current value I DC is measured by the drum film thickness measuring circuit 9. Meanwhile, using various photosensitive drums 1 whose film thicknesses are already known, relation between the film thickness and the direct current component current value I DC is obtained as shown in FIG. 3. Using FIG. 3, measurement of the direct current component current value I DC gives film thickness of the photosensitive layer of the photosensitive drum 1. Furthermore, the surface roughness (ten-point-mean roughness) Rz of the photosensitive layer of the photosensitive drum 1 becomes larger as the used number of sheets (endurable sheet number) increases as shown in FIG. 4.

As indicated in the results, the measurement of the current value I DC of the direct current component flowing out of the charging bias power source 8 renders the film thickness of the photosensitive layer of the photosensitive drum 1 known, and based on FIGS. 2 to 4, relationship between the film thickness of the photosensitive layer of the photosensitive drum 1 and the surface roughness Rz is obtained as shown in FIG. 5. Thus, measurement of the direct current component current value I DC enables the user to presume the surface roughness Rz of the photosensitive layer of the photosensitive drum 1.

If occurrences of the turning over of the cleaning blade 6*a* and sticking of toner, though may vary depending on the material and structure of the cleaning blade 6*a* and the photosensitive drum 1, are considerable, from our experiences, when the surface roughness Rz of the photosensitive layer of the photosensitive drum 1 is 1 micrometer or less, it would be better to supply toner of a proper amount and proper time to the cleaning portion where the cleaning blade 6*a* is in contact with the photosensitive drum 1, according to the following steps.

The user first pushes a copy start button or does other similar operation, and then, the charging bias power source 8 applies the charging bias voltage to the charging roller 2 during a so-called pre-rotation period that formation of images is not started yet, after the photosensitive drum 1 starts to rotate. The drum film thickness measuring circuit 9 detects the direct current component current value I DC flowing at that time, and the apparatus computes the data to measure the film thickness of the photosensitive layer of the photosensitive drum 1.

A surface correction toner image forming means for forming a toner image extending parallel to the rotation axis direction of the photosensitive drum 1 at a non-image area where no image is formed on the photosensitive layer surface of the photosensitive drum 1 in order to correct friction force of the photosensitive layer of the photosensitive drum 1 serving as the image carrier, is described.

In this embodiment, the charging potential of the photosensitive layer surface of the photosensitive drum 1 by the charging roller 2 is about −700 volts. A laser beam is emitted corresponding to the image signal or image information from the image exposing mean 3 to the photosensitive drum 1 the surface of which is uniformly charged by the charging roller 2, to create an electrostatic latent image.

The developing means 4 has a reverse developing method's structure in which a developing bias voltage (direct current component of −600 volts and alternating current component of 1,000 volts peak to peak) is fed from the developing bias power source 10 to the developing sleeve 4*a* carrying toner charged negatively through triboelectricity and thereby develops toner with an electrical field existing between the surface of the photosensitive drum 1 and the developing sleeve 4*a*.

The toner image formed on the photosensitive drum 1 is transferred onto a transfer material S. The charging bias power source 8 and the developing bias power source 10 remain being turned on for a predetermined period (see, FIG. 6) while the photosensitive drum 1 rotates (during a subsequent rotation) after a time t0 when the prescribed image formation is completed. The laser beam is already turned off at the time t0.

As shown in FIG. 6, the charging bias power source 8 is turned off at a time t1, and the charging roller 2 charges at about −700 volts the surface area of the photosensitive drum 1 proportioned to a traveling distance of the rotated surface of the photosensitive drum 1 between the time t0 to the time t1. The developing bias power source 10 is turned on only during period T1 between a time t2 and a time t3 while the charging area passes the developing sleeve 4*a* after the time t1, and toner is supplied from the developing sleeve 4*a* onto a non-image area on the surface of the photosensitive drum 1, thereby forming a surface correction toner image. The developing bias power source 10 is turned off at the time t3. The toner is developed during a period T1 because the developing bias power source 10 is turned on while the surface of the photosensitive drum 1 is almost not charged at all.

The controller 11, according to the film thickness of the photosensitive layer of the photosensitive drum 1 measured by the drum film thickness measuring circuit 9 during the previous rotation, controls the charging bias power source 8 and the developing bias power source 10 and sets the period T1. As shown in FIG. 7, the apparatus can therefore supply toner of an optimum amount to the cleaning portion at which the cleaning blade 6*a* and the photosensitive drum 1 are in contact with one another by forming toner image for surface correction of the optimum amount at the non-image area on the surface of the photosensitive drum 1.

The toner image for surface correction during the subsequent rotation of the photosensitive drum 1 is not necessarily formed at each time. In this embodiment, formation frequency of the surface correction toner image is controlled as the formation condition of the surface correction toner image. As a frequency of formation of the surface correction toner image, the apparatus may set that the surface correction toner image is formed once every fifty times when the photosensitive drum 1 is not much used and has a small surface roughness and when a direct current component current value I DC of the charging bias power source 8 equal to the endurable sheet number of about ten thousand or less (in this embodiment, about 22.5 microamperes or less) is detected.

When the surface of the photosensitive drum 1 experiences more WEAR and increases the surface roughness of the photosensitive drum 1 and when a direct current component current value I DC of the charging bias power source 8 equal to the endurable sheet number of about ten thousand to twenty thousand (in this embodiment, about 22.5 to 24.5 microamperes) is detected as a current that hardly raises a problem of turning over of the cleaning blade 6a or sticking of toner, the apparatus may set that the number of formations of the surface correction toner image is reduced to once every one hundred times.

When the surface of the photosensitive drum 1 experiences further WEAR and when a direct current component current value I DC of the charging bias power source 8 equal to the endurable sheet number of about twenty thousand or above (in this embodiment, about 24.5 microamperes or greater) is detected, the apparatus may set that the number of formations of the surface correction toner image is reduced to once every two hundred times.

According to the apparatus's structure thus described, the optimum toner amount corresponding to the surface roughness of the photosensitive drum 1 can be supplied to the cleaning portion at which the cleaning blade 6*a* and the photosensitive drum 1 are in contact with one another, and therefore, the toner particles can reduce friction force between the cleaning blade 6*a* and the photosensitive drum 1 to efficiently prevent the cleaning blade 6*a* from turning over and prevent the toner from sticking, so that the apparatus suppresses excessive consumption of the toner.

As a formation method of the surface correction toner image, what is controlled is only timings of turning-off of the charging bias power source 8 and the developing bias power source 10 during the subsequent rotation of the photosensitive drum 1 where the existing charging bias power source 8 and developing bias power source 10 are used as they are. Therefore, to form the surface correction toner image, no separate special additional device is required, so that the apparatus can reduce the number of parts and costs.

Figure 8A:
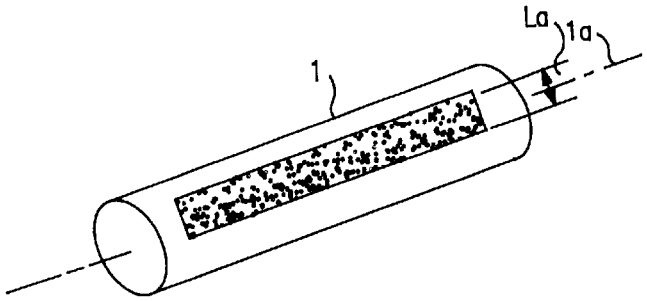
FIGS. 8(*a*), 8(*b*) are illustrations showing structures of surface correction toner images, respectively, formed on the surface of an image carrier in a second embodiment of the image forming apparatus according to the invention.
Figure 8B:
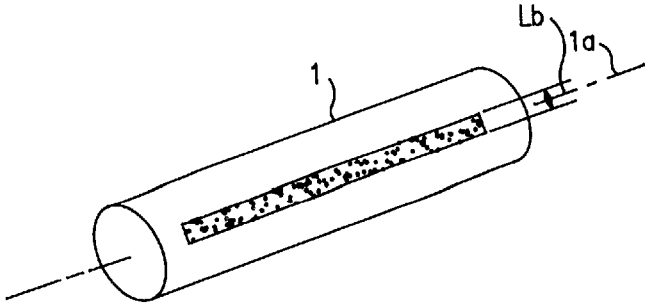

Referring to FIGS. 8(*a*), 8(*b*), a structure of a second embodiment according to the invented image forming apparatus is described. FIGS. 8(*a*), 8(*b*) are illustrations showing structures of surface correction toner images, respectively, formed on the surface of an image carrier in the second embodiment of the image forming apparatus according to the invention. In this embodiment, the same structural elements as in the first embodiment are given the same reference numbers as in the first embodiment, and a description is omitted for the sake of simplicity.

Although in the first embodiment, the formation frequency of the surface correction toner image is changed corresponding to the surface roughness of the photosensitive drum 1 as a formation condition of the surface correction toner image, a length L of the surface correction toner image in a circumferential direction of the surface of the photosensitive drum 1 is changed instead of the formation frequency of the surface correction toner image in this embodiment.

When the surface roughness of the photosensitive drum 1 is small, the period T1 shown in FIG. 6 in the first embodiment is set larger to enlarge the length La of the surface correction toner image in the circumferential direction of the surface of the photosensitive drum 1 as shown in FIG. 8 and thereby to form the surface correction toner image with a relatively larger area. When the drum film thickness measuring circuit 9 detects that the surface roughness of the photosensitive drum 1 comes to increase due to WEAR, the period T1 shown in FIG. 6 is set smaller to shorten the length La of the surface correction toner image in the circumferential direction of the surface of the photosensitive drum 1 as shown in FIG. 8(*b*) and thereby to form the surface correction toner image with a relatively narrower region. Other structural elements are the same as those in the first embodiment, and this structure brings substantially the same effects as in the first embodiment.

Figure 9A:
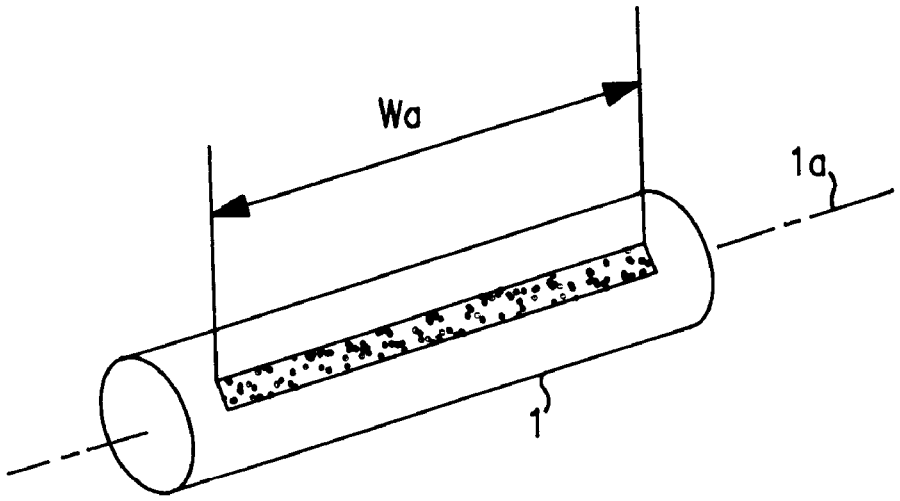
FIGS. 9(*a*), 9(*b*) are illustrations showing structures of surface correction toner images, respectively, formed on the surface of an image carrier in a third embodiment of the image forming apparatus according to the invention.
Figure 9B:
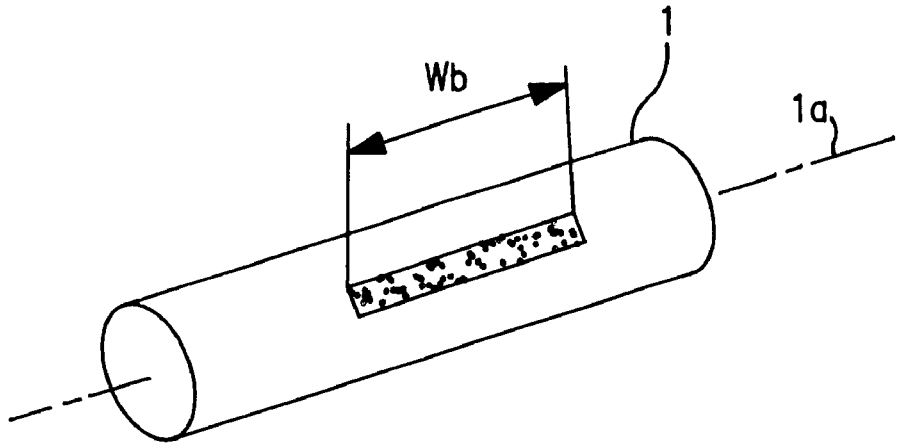
Figure 10:
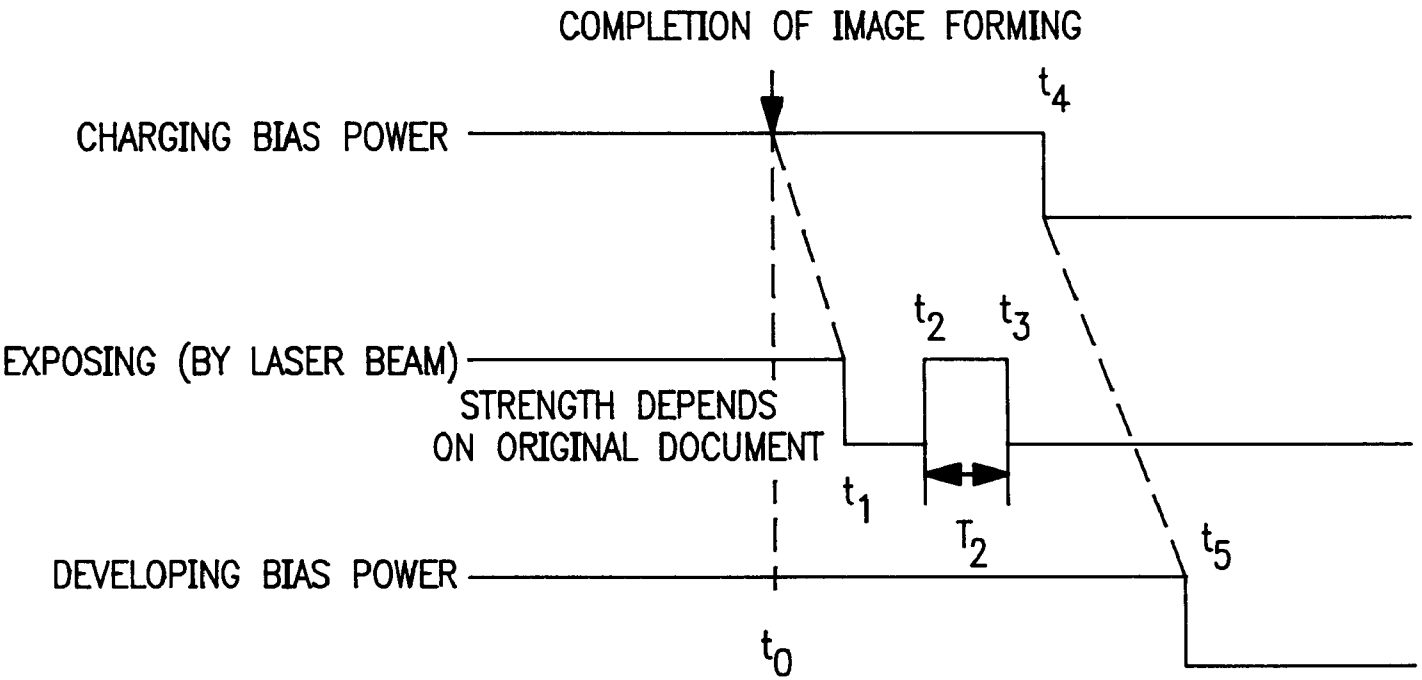
FIG. 10 is a time chart illustrating formation operation of a surface correction toner image of a third embodiment.

Referring to FIGS. 9(*a*), 9(*b*), and FIG. 10, a structure of a third embodiment according to the invented image forming apparatus is described. FIGS. 9(*a*), 9(*b*) are illustrations showing structures of surface correction toner images, respectively, formed on the surface of an image carrier in a third embodiment of the image forming apparatus according to the invention; FIG. 10 is a time chart illustrating formation operation of a surface correction toner image of a third embodiment. In this embodiment, the same structural elements as in the first embodiment are given the same reference numbers as in the first embodiment, and a description is omitted for the sake of simplicity.

In this embodiment, a length W of the surface correction toner image in a direction of the rotation axis 1*a* of the photosensitive drum 1, as a formation condition for the surface correction toner image, is changed. That is, when the surface roughness of the photosensitive drum 1 is small, the surface correction toner image is formed with the length Wa extending in the direction of the rotation axis 1*a* of the photosensitive drum 1 across the entire area of a possible image formation area on the surface of the photosensitive drum 1 as shown in FIG. 9(*a*). When the drum film thickness measuring circuit 9 detects that the surface roughness of the photosensitive drum 1 is made larger due to WEAR, the exposure width in the direction of the rotation axis 1*a* of the photosensitive drum 1 scanned by the image exposing means 3 is made narrower, and the surface correction toner image is formed with a relatively shorter length Wb in the direction of the rotation axis 1*a* of the photosensitive drum 1.

In this situation, as shown in FIG. 10, the charging bias power source 8 and the developing bias power source 10 are kept to be turned on for a prescribed period while the photosensitive drum 1 rotates (during subsequent rotation), after the toner image on the photosensitive drum 1 is transferred onto the transfer material S and the prescribed image formation is completed. The laser beam emitted from the image exposing means 3 is tuned off once at a time t1 that a prescribed period passes after the image formation is completed.

The image exposing means 3 is then turned on again for a period T2 between a time t2 that a prescribed period passes further and a time t3, and the laser beam is emitted on the surface of the photosensitive drum 1 charged by the charging roller 2 to form an electrostatic latent image for forming a surface correction toner image. The non-image area of the surface of the photosensitive drum 1 receives toner while that area passes the developing sleeve 4*a*, thereby forming the surface correction toner image. After the image exposing means 3 is turned off at the time t3, the charging bias power source 8 and the developing bias power source 10 are turned off at times t4, t5, respectively. The developing bias power source 10 may be turned off right after the surface area of the charged photosensitive drum 1 passes the developing sleeve 4*a*.

The controller 11, according to the film thickness of the photosensitive layer of the photosensitive drum 1 measured by the drum film thickness measuring circuit 9 during the previous rotation period, controls the image exposing means 3, the charging bias power source 8, and the developing bias power source 10 and adjusts the period T2 and the scanning width in the direction of the rotation axis 1*a* on the surface of the photosensitive drum 1 by the image exposing means 3.

That is, when the photosensitive drum 1 is still not used much and has a small surface roughness, the laser beam from the image exposing means 3 is scanned over the length Wa extending in the direction of the rotation axis 1*a* of the photosensitive drum 1 as the entire area of a possible image formation area on the surface of the photosensitive drum 1 as shown in FIG. 9(*a*), thereby forming a surface correction toner image with the length Wa having the entire area size of the possible image formation area in the direction of the rotation axis 1*a* of the photosensitive drum 1 on the surface of the photosensitive drum 1.

When the drum film thickness measuring circuit 9 detects that the surface roughness of the photosensitive drum 1 is made larger due to WEAR, the exposure width of the laser beam in the direction of the rotation axis 1*a* of the photosensitive drum 1 scanned by the image exposing means 3 is made narrower as extending only around the center in the direction of the rotation axis 1*a* of the photosensitive drum 1, and as shown in FIG. 9(*b*), the surface correction toner image is formed with a relatively shorter length Wb in the direction of the rotation axis 1*a* of the photosensitive drum 1.

Other structural elements are formed in the same way as in the first embodiment. According to the structure thus formed, as shown in FIGS. 9(*a*), 9(*b*), toner of the optimum amount can be supplied to the cleaning portion at which the cleaning blade 6*a* and the photosensitive drum 1 are in contact with one another, by forming the surface correction toner image of the optimum amount corresponding to the surface roughness of the photosensitive drum 1 at a non-image area on the surface of the photosensitive drum 1, and the apparatus of this embodiment can obtain substantially the same effect as in the first embodiment.

With this structure, it is relatively easy to change the scanning width W of the laser beam by a digital type image exposing means 3. With an image forming apparatus of so-called analog type, in which light from a lamp is radiated to the original document surface and the reflected light is directly emitted, the lamp light or LED (light emitting device) light can be emitted for the necessary area at timings described above, thereby forming the surface correction toner image in substantially the same manner.

Figure 11A:
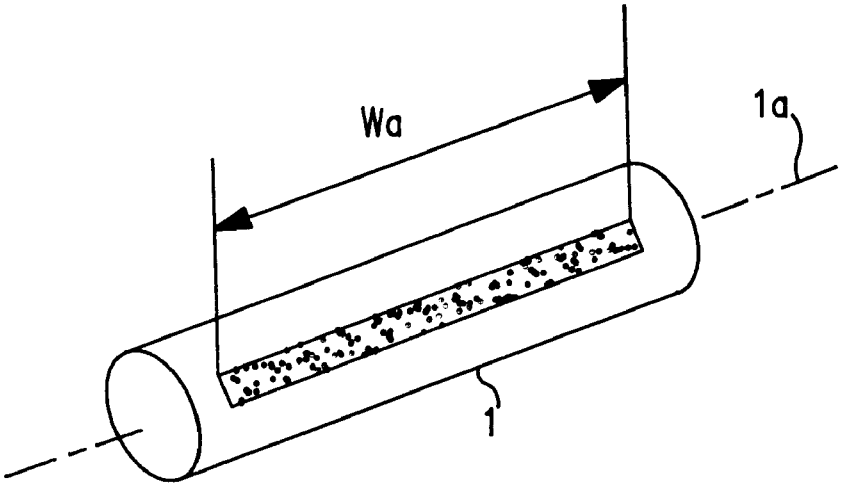
FIGS. 11(*a*), 11(*b*) are illustrations showing structures of surface correction toner images, respectively, formed on the surface of an image carrier in a fourth embodiment of the image forming apparatus according to the invention.
Figure 11B:
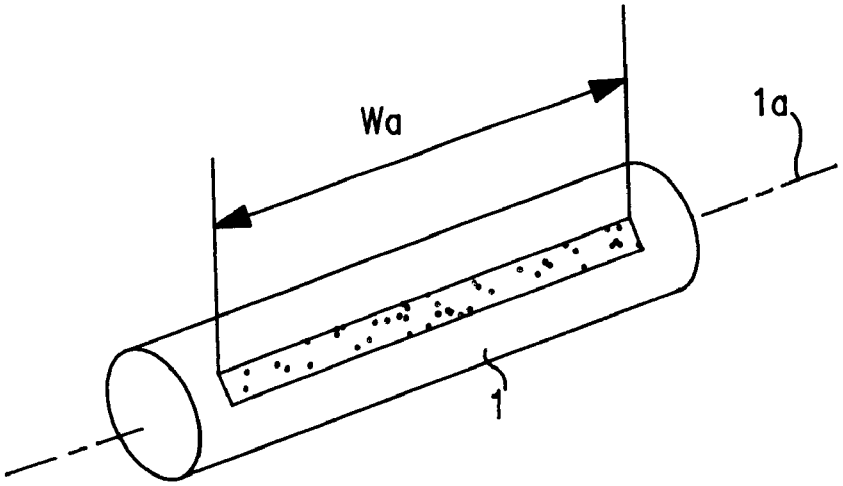

Next, referring to FIGS. 11(*a*), 11(*b*), a structure of a fourth embodiment according to the invented image forming apparatus is described. FIGS. 11(*a*), 11(*b*) are illustrations showing structures of surface correction toner images, respectively, formed on the surface of an image carrier in the fourth embodiment of the image forming apparatus according to the invention. In this embodiment, the same structural elements as in the first, third embodiments are given the same reference numbers as in the first, third embodiments, and a description is omitted for the sake of simplicity.

In this embodiment, the density of the surface correction toner image is changed as a formation condition of the surface correction toner image. That is, when the photosensitive drum 1 is not yet much used and has a small surface roughness of the photosensitive drum 1, the density per unit area of the surface correction toner image is made high as shown in FIG. 11(*a*), or in other words, the toner image is formed with a thicker thickness. When the drum film thickness measuring circuit 9 detects that the surface roughness of the photosensitive drum 1 is made larger due to worn, the density per unit area of the surface correction toner image is made low as shown in FIG. 11(*a*), or in other words, the toner image is formed with a thinner mean thickness.

Drive timings of the charging bias power source 8, the developing bias power source 10, and the image exposing means 3 for forming an surface correction toner image in this embodiment are made in substantially the same manner as in the third embodiment as described above as shown in FIG. 10, and the scanning width W of the laser beam by the image exposing means 3 is set to the length Wa extending in the direction of the rotation axis 1*a* of the photosensitive drum 1 as the entire area of a possible image formation area on the surface of the photosensitive drum 1.

The image forming apparatus changes an emitting amount of the laser beam emitted from the image exposing means 3, or in other words, the density of photo energy radiated onto the surface of the photosensitive drum 1, as for changing the density of the surface correction toner image.

With the image forming apparatus of the embodiment, the laser beam is radiated to the surface of the uniformly charged photosensitive drum 1, and the surface correction toner image is developed at an area of the photosensitive drum 1 where the charged potential is low. Therefore, when the photosensitive drum 1 is still not used much and has a small surface roughness, a light amount of the laser beam corresponding to the surface correction toner image is made larger to increase the toner amount to be formed (see, FIG. 11(*a*)). When the drum film thickness measuring circuit 9 detects that the surface roughness of the photosensitive drum 1 is made larger due to worn, a light amount of the laser beam corresponding to the surface correction toner image is made smaller to reduce the toner amount to be formed (see, FIG. 11(*b*)).

Other structural elements are formed in the same way as in the first embodiment. According to the structure thus formed, as shown in FIGS. 11(*a*), 11(*b*), toner of the optimum amount can be supplied to the cleaning portion at which the cleaning blade 6*a* and the photosensitive drum 1 are in contact with one another, by forming the surface correction toner image of the optimum amount corresponding to the surface roughness of the photosensitive drum 1 at a non-image area on the surface of the photosensitive drum 1, and the apparatus of this embodiment can obtain substantially the same effect as in the first embodiment. It is to be noted that an image density may be changed to change an apparent density as of dot images, even though the thickness of the surface correction toner image is the same on the surface of the photosensitive drum 1.

Figure 12A:
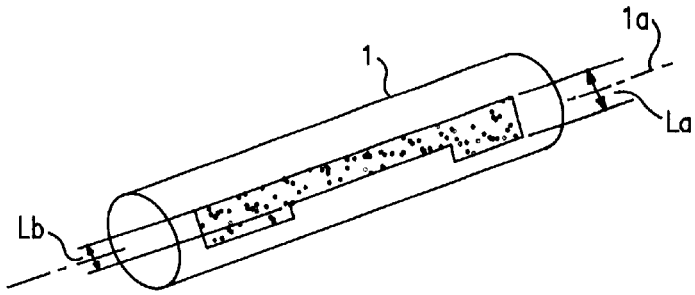
FIGS. 12(*a*) to 12(*c*) are illustrations showing structures of surface correction toner images, respectively, formed on the surface of an image carrier in a fifth embodiment of the image forming apparatus according to the invention.
Figure 12B:
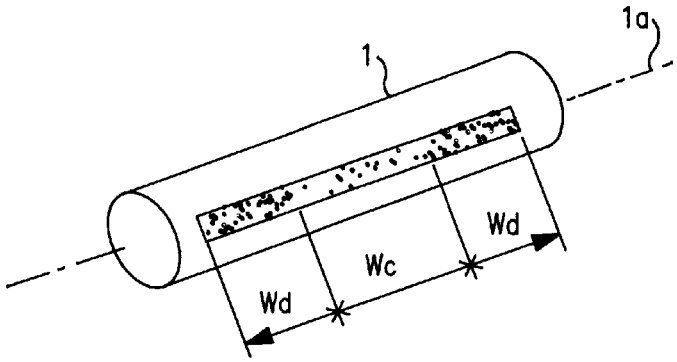
Figure 12C:
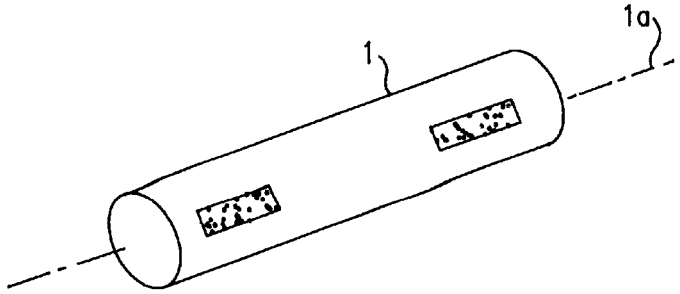

Referring to FIGS. 12(*a*) to 12(*c*), a structure of a fifth embodiment according to the invented image forming apparatus is described. FIGS. 12(*a*) to 12(*c*) are illustrations showing structures of surface correction toner images, respectively, formed on the surface of an image carrier in a fifth embodiment of the image forming apparatus according to the invention. In this embodiment, the same structural elements as in the first, third embodiments are given the same reference numbers as in the first, third embodiments, and a description is omitted for the sake of simplicity.

As described above, when the photosensitive drum 1 is still not used much and has a small surface roughness, problems such as turning over of the cleaning blade 6*a* and sticking of toner, etc., frequently occur. In particular, turning over of the cleaning blade 6*a* frequently occurs from the end of the blade. Therefore, as shown in FIGS. 12(*a*) to 12(*c*), if the surface correction toner image is formed as to increase the toner amount on the surface of the photosensitive drum 1 at the ends (front and rear sides) in the direction of the rotation axis 1*a* of the photosensitive drum 1, the turning over of the cleaning blade 6*a* starting from the ends is effectively prevented.

That is, as shown in FIG. 12(*a*), a length La of the surface correction toner image in the circumferential direction of the photosensitive drum 1 at the ends of the photosensitive drum 1 in the direction of the rotation axis 1*a* of the photosensitive drum 1 is made larger than a length Lb in the circumferential direction of the photosensitive drum 1 at the center of the photosensitive drum 1, thereby suppressing excessive toner consumption and preventing the cleaning blade 6*a* from turning over and the toner from sticking.

As shown in FIG. 12(*b*), substantially the same effect can be obtained by making higher the toner density at the ends (Wd) of the surface correction toner image in the direction of the rotation axis 1*a* of the photosensitive drum 1. That is, when the photosensitive drum 1 is still not used much and has a small surface roughness, the surface correction toner image can have a regular thickness at the center (Wc) in the direction of the rotation axis 1*a* of the photosensitive drum 1 but have a thicker thickness at ends (Wd) in the direction of the rotation axis 1*a* of the photosensitive drum 1, thereby particularly preventing the cleaning blade 6*a* from subject to turning over at the ends of the blade.

The regular surface correction toner image as shown in FIG. 7 is formed, e.g., once every two hundred sheets, and when the photosensitive drum 1 comes to have a smaller surface roughness as of an endurable sheet number within about ten thousand sheets or equivalent, the controller adds operation for forming the surface correction toner image once every fifty sheets as shown in FIG. 12(*c*) only at ends in the direction of the rotation axis 1*a* of the photosensitive drum 1. When the photosensitive drum 1 comes to have a smaller surface roughness as of an endurable sheet number of about ten to twenty thousand sheets or equivalent, the controller adds operation for forming the surface correction toner image once every one hundred sheets as shown in FIG. 12(*c*) only at ends in the direction of the rotation axis 1*a* of the photosensitive drum 1. Furthermore, when the photosensitive drum 1 comes to have a smaller surface roughness as of an endurable sheet number of about twenty thousand sheets or equivalent or greater, the controller may add no operation for forming the surface correction toner image once every fifty sheets as shown in FIG. 12(*c*) only at ends in the direction of the rotation axis 1*a* of the photosensitive drum 1.

Figure 13A:
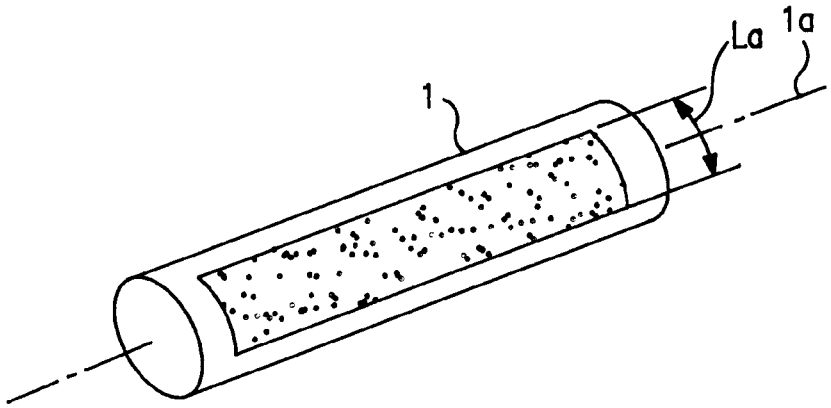
FIGS. 13(*a*), 13(*b*) are illustrations showing structures of surface correction toner images, respectively, formed on the surface of an image carrier in a sixth embodiment of the image forming apparatus according to the invention.
Figure 13B:
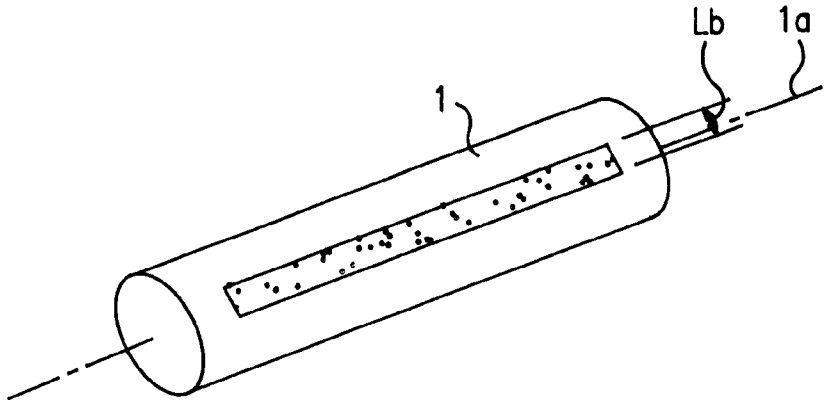

Referring to FIGS. 13(*a*), 13(*b*), a structure of a sixth embodiment according to the invented image forming apparatus is described. FIGS. 13(*a*), 13(*b*) are illustrations showing structures of surface correction toner images, respectively, formed on the surface of an image carrier in the sixth embodiment of the image forming apparatus according to the invention. In this embodiment, the same structural elements as in the first, third embodiments are given the same reference numbers as in the first, third embodiments, and a description is omitted for the sake of simplicity.

In the second embodiment, timing differences of turned-off operations between the charging bias power source 8 and the developing bias power source 10 during the subsequent rotation period of the photosensitive drum 1 are utilized, as of the surface correction toner image forming means, in order to change the length L in the circumferential direction of the surface of the photosensitive drum 1, as a method to control the toner amount of the surface correction toner image. With this constitution, there is a merit that the system can be used even in digital image forming apparatuses without adding any special device, but the surface correction toner tends to be developed with a remarkably thick thickness, so that a part of the surface correction toner may be scattered in other portions in the apparatus before reaching the cleaning blade 6*a* or so that a part of the surface correction toner is overflowed from the waste toner container 6*b* and spilt over the apparatus to render the apparatus dusted because a large amount toner is supplied to the cleaning means 6 at once and gives an overload to the cleaning blade 6*a*.

In this embodiment, to solve those problems, the surface correction toner image forming means is so constituted that the density and formation area of the surface correction toner image is controlled by controlling the scanning area of the laser beam of the image exposing means 3 and the light amount of the laser beam as described in the respective embodiments above.

That is, a surface correction toner image with a thinner thickness is formed by reducing the light amount of the laser beam, and the controller controls lengths L of the surface correction toner image in the circumferential direction of the surface of the photosensitive drum 1 corresponding to the surface roughness of the photosensitive drum 1 to be different lengths La, Lb as shown in FIGS. 13(*a*), 13(*b*), thereby preventing the inside of the apparatus from becoming dusted, as well as obtaining substantially the same effects as in the first embodiment.

Next, a structure of an image forming apparatus of a seventh embodiment according to the invention is described. In the respective embodiments above, as a method to presume the surface roughness of the photosensitive drum 1, the image forming apparatus detects the direct current component current value I DC flowing in a direction from the charging roller 2 to the photosensitive drum 1, computes a film thickness of the photosensitive layer of the photosensitive drum 1, and presumes the surface roughness from the film thickness. The merit of this method is the apparatus can presume a relatively accurate surface roughness regardless image formation modes (continuos print, intermittent print, etc.) or size of the transfer materials, etc.. However, if the apparatus uses a non-contact means not contacting to the photosensitive drum 1 such as a corona charger serving as charging means, it would be difficult to detect a physical property value reflecting a film thickness of a photosensitive film like the direct current component current value I DC flowing in a direction toward the photosensitive drum 1.

To overcome this hardship, in this embodiment, the image forming apparatus memorizes the number of printed sheets and detects the sheet number, to control the density, torn, frequency, area size, shape, etc., of the surface correction toner image in the same manner as above. Because the surface roughness of the photosensitive drum 1 is changeable depending on the size of the transfer material S, the formation method of the surface correction toner image can be corrected at appropriate times according to the size.

Figure 14A:
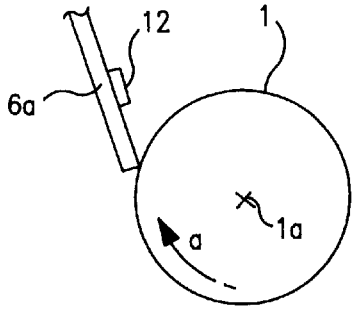
FIGS. 14(*a*), 14(*b*) are illustrations showing structures of an image carrier and a detector for detecting friction force to a cleaning blade in an eighth embodiment of the image forming apparatus according to the invention.
Figure 14B:
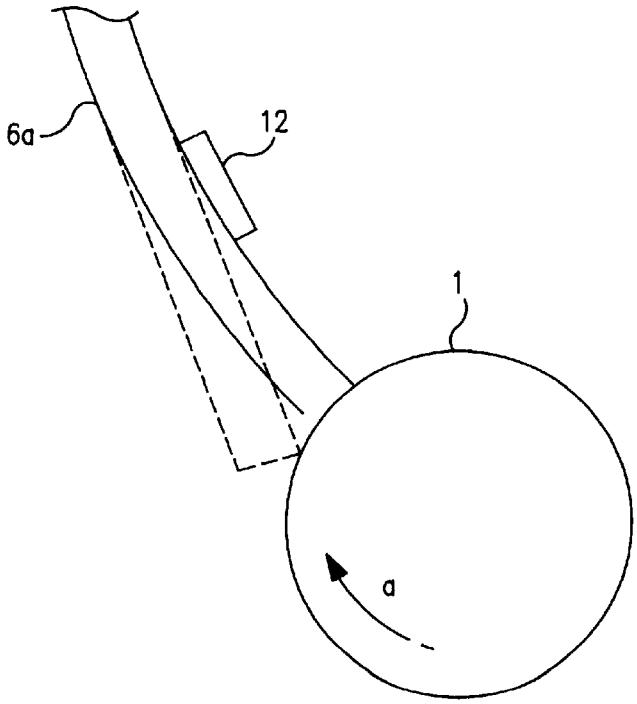
Figure 15:
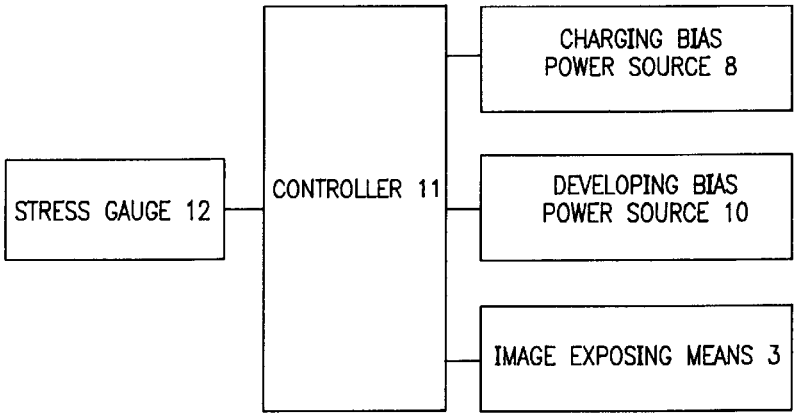
FIG. 15 is a block diagram showing a structure of a controlling system in the eighth embodiment.
Figure 16A:
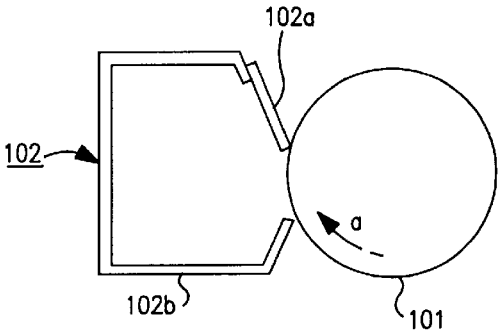
FIG. 16 is a diagram illustrating a conventional image forming apparatus.
Figure 16B:
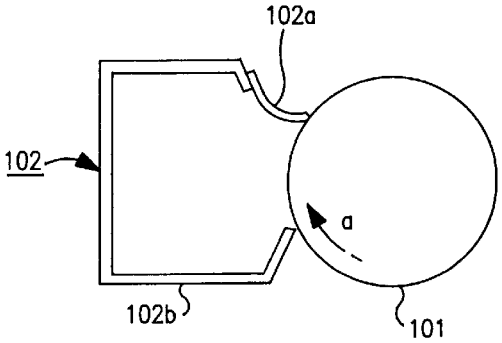

Referring to FIGS. 14(*a*), 14(*b*), and 15, a structure of an eighth embodiment according to the invented image forming apparatus is described. FIGS. 14(*a*), 14(*b*) are illustrations showing structures of an image carrier and a detector for detecting friction force to a cleaning blade in an eighth embodiment of the image forming apparatus according to the invention; FIG. 15 is a block diagram showing a structure of a controlling system in the eighth embodiment. In this embodiment, the same structural elements as in the first, third embodiments are given the same reference numbers as in the first embodiments, and a description is omitted for the sake of simplicity.

In the respective embodiments above, the image forming apparatus measures or estimates a film thickness of the photosensitive layer of the photosensitive drum 1 as a physical property value reflecting the surface roughness of the photosensitive drum 1 and presumes the surface roughness of the photosensitive drum 1 from the detected film thickness. To the contrary, in this embodiment, the apparatus measures stress force in the cleaning blade 6*a* as a physical property value reflecting the surface roughness of the photosensitive drum 1. As shown in FIGS. 14(*a*), 14(*b*), a stress gauge 12 serving as measuring means for measuring the stress force in the cleaning blade 6*a* is mounted to the cleaning blade 6*a*, and the apparatus presumes the surface roughness of the photosensitive drum 1 according to the stress force in the cleaning blade 6*a* measured by the stress gauge 12.

When the photosensitive drum 1 is not much used and at an initial stage of use, and when the surface roughness of the photosensitive drum 1 is still small, the cleaning blade 6*a* may be easily bent greatly according to rotation of the photosensitive drum 1 because the friction between the photosensitive drum 1 and the cleaning blade 6*a* is large.

FIG. 14(*b*) is an enlarged cross section showing a cleaning portion where the edge of the cleaning blade 6*a* is in contact with the surface of the photosensitive drum 1. While the photosensitive drum 1 is not moving, the cleaning blade 6*a* is not bent as shown by a broken line in FIG. 14(*b*), and if the photosensitive drum 1 rotates in an arrow direction in FIG. 14(*b*), the cleaning blade 6a is bent as shown in a solid line in FIG. 14(*b*).

The bent amount of the cleaning blade 6*a* at that time depends on friction force between the surface of the photosensitive drum 1 and the edge of the cleaning blade 6*a* in contact with the photosensitive drum 1. The apparatus measures the bent amount of the cleaning blade 6*a* by means of the stress gauge 12, and when the bent amount reaches a predetermined value or greater, the controller 11 shown in FIG. 15 controls in a proper manner the charging bias power source 8, the developing bias power source 10, and the image exposing means 3 to form a surface correction toner image on a non-image area on the surface of the photosensitive drum 1 in the same manner as in the respective embodiments above, thereby preventing the cleaning blade 6*a* from turning over and preventing the toner from sticking upon reducing the friction force with the toner particles by supplying toner of a proper amount to the cleaning portion where the photosensitive drum 1 and the cleaning blade 6*a* are in contact with one another.

As described above, the surface roughness of the photosensitive drum 1, though having a strong correlation to the film thickness of the photosensitive layer on the surface of the photosensitive drum 1, raises problems such that the film thickness data may vary more or less depending on circumstances (e.g. temperature and humidity) and kinds of the transfer materials S to be used, differences of image formation modes and that the friction force exerting between the cleaning blade 6*a* and the photosensitive drum 1 may vary largely depending on circumstances of use and differences of image formation modes. According to the structure of this embodiment, detection of the stress of the cleaning blade 6*a* itself instead of the measurement of the film thickness of the photosensitive layer of the photosensitive drum 1 renders the friction force exerting between the cleaning blade 6*a* and the photosensitive drum 1 reflected accurately to the stress of the cleaning blade 6*a*, so that a further appropriate timing for forming the surface correction toner image is obtainable. Moreover, this embodiment is also applicable to an image forming apparatus using a non-contact means that does not contact to the photosensitive drum 1 like a corona charger serving as charging means. It is to be noted that as another structure, the formation of the correction toner image can be controlled according to mechanical vibrations caused by reciprocal movements of the cleaning blade 6*a*, not according to the bent amount of the cleaning blade 6*a* itself.

Described above are a method in which the surface roughness of the photosensitive drum 1 is presumed from the film thickness of the photosensitive layer of the photosensitive drum 1 as a physical property value reflecting the surface roughness, a method in which a number of image printed sheets is calculated, a method in which the stress gauge 12 mounted to the cleaning blade 6*a* measures the friction force between the cleaning blade 6*a* and the photosensitive drum 1, and so forth. However, methods for measuring the surface roughness of the photosensitive drum 1 or the physical property value reflecting the surface roughness are not limited to those methods above, and other methods, e.g., such as a method in which the formation of the surface correction toner image is controlled according to a torque size at a time that the photosensitive drum 1 is driven, can be useful.

Although in the respective embodiments above, the existing charging bias power source 8, developing bias power source 10, image exposing means 3, etc. are used to constitute the surface correction toner image forming means, a separate special supplying means for supplying the surface correction toner image can be provided as separated from the developing sleeve 4, and in such a case, toner to be used may have contents different from the toner used for image formation to make the correction effectuated. It is to be noted that although in the description above, the supply amount or frequency of toner is reduced as the surface roughness of the photosensitive drum 1 increases, the toner's sticking may occur more frequently as the surface roughness of the photosensitive drum 1 increases depending on the prescription of the photosensitive drum 1 and the material of the cleaning blade 6*a*. In such a case, the image forming apparatus may control the toner supply amount and frequency to increase, and such controlling ways are not limited.

Since having the structure and effects as described above, the invented image forming apparatus suppresses excessive toner consumption by changing the surface correction toner image to be formed on the non-image area on the surface of the image carrier corresponding to the value measured by the measuring means for measuring the surface roughness of the image carrier or the physical property value reflecting the surface roughness of the image carrier and can form good images upon preventing the cleaning blade from turning over and preventing the toner from sticking by preventing the friction force between the image carrier and the cleaning means (cleaning blade) from becoming excessive.

Where the measuring means measures or estimates the film thickness of the photosensitive layer of the image carrier or the physical property value reflecting the film thickness, toner of a large amount may be supplied at an initial stage of use where the photosensitive layer is still thick where the surface roughness is small and when the friction force between the image carrier and the cleaning means is large.

As a changing method for surface correction toner images, any one or more methods are selected from formation frequency of the surface correction toner image, length of the surface correction toner image in a circumferential direction of the surface of the image carrier, length of the surface correction toner image in a rotation axis direction of the image carrier, and density of the surface correction toner image. The image forming apparatus therefore can supply toner of a proper amount corresponding to the surface roughness of the image carrier, thereby preventing the cleaning blade from turning over and preventing the toner from sticking, and eliminating unnecessary consumption of toner by suppressing excessive toner supply as to bring economical advantages.

The image forming apparatus according to the invention can supply toner without any special additional device by changing the formation condition of the surface correction toner image by controlling the potential contrast between the surface potential of the image carrier and the surface potential of the developer carrier of the developing means. Moreover, the image forming apparatus controls the formation of the surface correction toner image by any one method or a combination of methods selected from uses of the developing bias voltage applying to the developing means, the charging bias voltage, and the exposure amount by the image exposing means, thereby controlling the toner supply amount and the timings to be the optimum values, and preventing the cleaning blade from turning over and preventing the toner from sticking without consuming toner excessively. Moreover, the image forming apparatus supplies a large amount toner to the ends of the cleaning blade in comparison with the center of the blade, thereby effectively preventing the cleaning blade from turning over otherwise turning over from the ends of the blade.

What is claimed is:

1. An image forming apparatus comprising:

an image carrier rotatively driven;

charging means for uniformly charging a surface of the image carrier;

image exposing means for forming an electrostatic latent image on the surface of the image carrier on which the charging means uniformly charges, by exposing the surface according to image information;

developing means for developing a toner image from the electrostatic latent image formed by the image exposing means;

transferring means for transferring the toner image formed on the surface of the image carrier by the developing means onto a transfer material;

cleaning means for contacting to the surface of the image carrier to remove residual toner remaining on the surface of the image carrier after the toner image formed on the surface of the image carrier is transferred onto the transfer material by the transferring means;

measuring means for measuring a surface roughness or physical property value reflecting the surface roughness of the image carrier;

surface correction toner image forming means for forming a toner image extending in parallel to a direction of a rotation axis of the image carrier at a non-image area on the surface of the image carrier, the surface correction toner image forming means is incorporated in the developing means; and a controller for changing a formation condition of the surface correction toner image formed parallel to the direction of the rotation axis of the image carrier at the non-image area on the surface of the image carrier by the surface correction toner image forming means, according to the surface roughness or the physical property value reflecting the surface roughness of the image carrier measured by the measuring means.

2. The image forming apparatus according to claim 1, wherein the measuring means measures or estimates a film thickness of a photosensitive layer of the image carrier or physical property value reflecting the film thickness.

3. The image forming apparatus according to claim 1, wherein the measuring means includes a charging member for contacting to the image carrier and charging bias applying means for biasing the charging member and estimates a film thickness of a photosensitive layer of the image carrier from values of voltage of the charging bias and current flowing in the charging member at a time of charging operation.

4. The image forming apparatus according to claim 1, wherein the measuring means is a counting means for counting the number of printed sheets on which images are formed with the image carrier.

5. The image forming apparatus according to claim 1, wherein the measuring means is stress measuring means for measuring stress force of the cleaning means.

6. The image forming apparatus according to claim 1, wherein the surface correction toner image forming means is formed as separated from the developing means.

7. The image forming apparatus according to claim 1, wherein the controller changes, by controlling a voltage contrast between a voltage at the surface of the image carrier and a voltage at a surface of a developer carrier of the developing means at a prescribed time, the formation condition of the surface correction toner image created by the surface correction toner image forming means at the non-image area on the surface of the image carrier.

8. The image forming apparatus according to claim 1, wherein the formation conditions of the surface correction toner image is changed by changing a developing bias applying to the developing means.

9. The image forming apparatus according to claim 1, wherein the formation conditions of the surface correction toner image is changed by changing a scanning area of the image exposing means.

10. The image forming apparatus according to claim 1, wherein the formation conditions of the surface correction toner image is changed by changing a scanning area or an exposure amount of the image exposing means.

11. The image forming apparatus according to claim 1, wherein the controller makes smaller, formation frequency, formation area size, or formation density of the surface correction toner image, as the surface roughness of the image carrier is made larger, based on a measured value of the measuring means.

12. The image forming apparatus according to claim 1, wherein the controller makes larger, formation frequency, formation area size, or formation density of the surface correction toner image, as the surface roughness of the image carrier is made larger, based on a measured value of the measuring means.

13. The image forming apparatus according to any one of claims 1 to 11, or 12, wherein the formation condition of the surface correction toner image which is formed parallel to the direction of the rotation axis of the image carrier at a non-image area on the surface of the image carrier by the surface correction toner image forming means is formation frequency of the surface correction toner image.

14. The image forming apparatus according to claim 13, wherein the surface correction toner image forming means operates at a normal state to form the surface correction toner image and additionally operates to form the surface correction toner image only at ends in the axial direction of the image carrier more frequently than the normal state.

15. The image forming apparatus according to any one of claims 1 to 11, or 12, wherein the formation condition of the surface correction toner image which is formed parallel to the direction of the rotation axis of the image carrier at a non-image area on the surface of the image carrier by the surface correction toner image forming means is formation area size of the surface correction toner image.

16. The image forming apparatus according to claim 15, wherein the formation area size of the surface correction toner image is changed by a length of the surface correction toner image in a circumferential direction of the image carrier on the surface of the image carrier.

17. The image forming apparatus according to claim 16, wherein the formation area size of the surface correction toner image is changed by forming a length in a circumferential direction at the end in an axial direction of the image carrier larger than a length in the circumferential direction at the center of the image carrier in the axial direction.

18. The image forming apparatus according to claim 15, wherein the formation area size of the surface correction toner image is changed by a length of the surface correction toner image in an axial direction of the image carrier on the surface of the image carrier.

19. The image forming apparatus according to any one of claims 1 to 11, or 12, wherein the formation condition of the surface correction toner image which is formed parallel to the direction of the rotation axis of the image carrier at a non-image area on the surface of the image carrier by the surface correction toner image forming means is formation density of the surface correction toner image.

20. The image forming apparatus according to claim 19, wherein the formation density of the surface correction toner image is changed by rendering a formation density at the end of the image carrier in an axial direction of the carrier higher than a formation density at the center of the image carrier in the axial direction.

21. A cleaning apparatus for cleaning surface of an image carrier comprising:

a cleaning blade member for contacting the image carrier;

toner supplying means for supplying toner to contacting part of the cleaning blade member and the image carrier;

detecting means for detecting a surface roughness or physical property value reflecting the surface roughness of the image carrier; and controlling means for controlling supplying quantity of the toner supplying means according to a result of the detecting by the detecting means;

wherein said controlling means reduce the supplying toner quantity of the toner supplying means when the detecting means detect an increase of the surface roughness or the physical property value reflecting the surface roughness of the image carrier.

22. A cleaning apparatus according to claim 21, wherein the toner supplying means has toner image forming means to form a surface correction toner image on the image carrier.

23. A cleaning apparatus according to claim 22, wherein the surface correction toner image is a toner image which will not be transferred to the recording medium.

24. A cleaning apparatus according to claim 22, wherein the controlling means controls formation area size.

25. A cleaning apparatus according to claim 24, wherein the controlling means reduce the formation area size when the detecting means detects value of the surface roughness of the image carrier becomes larger.

26. A cleaning apparatus according to claim 24, wherein the controlling means change a length of the formation area size in circumferential direction of the image carrier.

27. A cleaning apparatus according to claim 24, wherein the controlling means changes a length of the formation area size in axial direction of the image carrier.

28. A cleaning apparatus according to claim 22, wherein the toner forming means forms the surface correction toner image at predetermined frequency and the controlling means controls image forming frequency of the toner supplying means.

29. A cleaning apparatus according to claim 28, wherein the controlling means reduce the image forming frequency when the detecting means detects value of the surface roughness of the image carrier becomes larger.

30. A cleaning apparatus according to claim 22, wherein the toner image forming means forms first surface correction toner image and after recording image on the recording medium at predetermined times forms second surface correction toner image, and the controlling means controls an image recording number between forming the first and the second surface correction toner images.

31. A cleaning apparatus according to claim 30, wherein the controlling means rises the image recording number between forming the first and the second surface correction toner images when the detecting means detects value of the surface roughness of the image carrier becomes larger.

32. A cleaning apparatus according to claim 22, wherein the image forming means has exposing means for exposing the image carrier, and the controlling means controls the exposing value of the exposing means.

33. A cleaning apparatus according to claim 22, wherein the toner image forming means forms a toner image on an exposed area of the image carrier and the controlling means reduces the value of the exposing means when the detecting means detects value of the surface roughness of the image carrier becomes larger.

34. A cleaning apparatus according to claim 22, wherein the toner image forming means has exposing means for exposing the image carrier and discharging means for discharging the image carrier before exposed, and the controlling means controls electric potential of the discharge means.

35. A cleaning apparatus according to claim 22, wherein the toner image forming means has a toner carrier facing the image carrier and voltage charging means for charging voltage to the toner carrier, and controlling means controls voltage of the voltage charging means.

36. A cleaning apparatus according to claim 21, wherein the controlling means controls toner supplying quantity supplied by the toner supplying means on end parts of the cleaning blade in length direction thereof.

37. A cleaning apparatus according to claim 36, wherein the controlling means reduces the toner supplying quantity on end parts of the cleaning blade when the detecting means detects value of the surface roughness of the image carrier becomes larger.

38. A cleaning apparatus according to claim 21, 22, 28, 30, or 36, wherein the controlling means controls a toner supplying quantity in an area unit.

39. A cleaning apparatus according to claim 38, wherein the controlling means reduces the toner supplying quantity in the area unit when the detecting means detects value of the surface roughness of the image carrier becomes larger.

40. A cleaning apparatus according to claim 21, wherein the detecting means has measuring means for measuring intensity of electric current of discharging means for discharging the image carrier.

41. A cleaning apparatus according to claim 21, wherein the detecting means has measuring means for counting rotations of the image carrier.

42. A cleaning apparatus according to claim 21, wherein the detecting means for counting number of recording medium on which toner image is formed.

43. A cleaning apparatus according to claim 21, wherein the detecting means has measuring means for measuring shrinking value of the cleaning blade.

44. A cleaning apparatus according to claim 21, wherein the detecting means has measuring means for measuring vibration of the cleaning blade.

45. A cleaning apparatus according to claim 21, wherein a free end of the cleaning blade is disposed at upstream side of a contacting point between the cleaning blade and the image carrier in rotate direction of the image carrier.

* * * * *

UNITED STATES PATENT AND TRADEMARK OFFICE

CERTIFICATE OF CORRECTION

PATENT NO. : 6,014,530
APPLICATION NO. : 09/026427
DATED : January 11, 2000
INVENTOR(S) : Takeo Tsunemi It is certified that error appears in the above-identified patent and that said Letters Patent is hereby corrected as shown below:

ON COVER PAGE

THE TITLE OF THE INVENTION SHOULD BE DELETED AND SUBSTITUTED WITH THE FOLLOWING TITLE:

--IMAGE FORMING APPARATUS COMPRISING AN IMPROVED IMAGE CARRIER CLEANING SYSTEM--

ON COVER PAGE AT [*] NOTICE:

Insert: --Notice: This patent issued on a continued prosecution application filed under 37 CFR 1.53(d), and is subject to the twenty year patent term provisions of 35 U.S.C. 154(a)(2).--.

COLUMN 5

Line 21, “invention.” should read --invention;--.

CLAIMS 6, 12, 30, 33 AND 35 SHOULD BE DELETED.

UNITED STATES PATENT AND TRADEMARK OFFICE

CERTIFICATE OF CORRECTION

PATENT NO. : 6,014,530
APPLICATION NO. : 09/026427
DATED : January 11, 2000
INVENTOR(S) : Takeo Tsunemi It is certified that error appears in the above-identified patent and that said Letters Patent is hereby corrected as shown below:

CLAIMS 1-5, 7-11, 13-29, 31, 32, 34 AND 36-45 SHOULD BE DELETED AND SUBSTITUTED WITH THE FOLLOWING CLAIMS 1-5, 7-11, 13-29, 31, 32, 34, AND 36- 45:

Col. 18, lines 28-65

--1. An image forming apparatus comprising:

an image carrier rotatively driven;

charging means for uniformly charging a surface of said image carrier;

image exposing means for forming an electrostatic latent image on the surface of said image carrier on which the charging means uniformly charges, by exposing the surface according to image information;

developing means for developing a toner image from the electrostatic latent image formed by the image exposing means;

transferring means for transferring the toner image formed on the surface of the image carrier by the developing means onto a transfer material;

cleaning means for contacting to the surface of said image carrier to remove residual toner remaining on the surface of said image carrier after the toner image formed on the surface of said image carrier is transferred onto the transfer material by said transferring means;

detecting means for detecting a surface roughness or an information reflecting the surface roughness of said image carrier;

supplying toner image forming means for forming a toner image to be supplied to the contacting portion between said cleaning and said image carrier extending in parallel to a direction of a rotation axis of said image carrier at a non-image area on the surface of said image carrier, said supplying toner image forming means is incorporated in said developing means; and a controller for changing a formation condition of said supplying toner image formed parallel to the direction of the rotation axis of said image carrier at the non-image area on the surface of said image carrier by said supplying toner image forming means, according to the surface roughness or the information reflecting the surface roughness of said image carrier detected by said detecting means.

Col. 18, Lines 66-2; should read;

2. The image forming apparatus according to Claim 1, wherein said measuring means measures or estimates a film thickness of a photosensitive layer of the image carrier or information reflecting a film thickness.

UNITED STATES PATENT AND TRADEMARK OFFICE

CERTIFICATE OF CORRECTION

PATENT NO. : 6,014,530
APPLICATION NO. : 09/026427
DATED : January 11, 2000
INVENTOR(S) : Takeo Tsunemi It is certified that error appears in the above-identified patent and that said Letters Patent is hereby corrected as shown below:

Col. 19, lines 3-10; should read;
3. The image forming apparatus according to Claim 1, wherein said measuring means includes a charging member for contacting to the image carrier and charging bias applying means for biasing the charging member and estimates a film thickness of a photosensitive layer of the image carrier from values of voltage of the charging bias and current flowing in the charging member at a time of charging operation.

Col. 19, lines 11-14; should read;
4. The image forming apparatus according to claim 1, wherein said measuring means is a counting means for counting the number of printed sheets on which images are formed with the image carrier.

Col. 19, lines 15-17; should read;
5. The image forming apparatus according to Claim 1, wherein said measuring means is stress measuring means for measuring stress force of said cleaning means.

Col. 19, lines 21-28; should read;
7. The image forming apparatus according to Claim 1, wherein said controller changes, by controlling a voltage contrast between a voltage at the surface of the image carrier and a voltage at a surface of a developer carrier of the developing means at a prescribed time, the formation condition of said supplying toner image created by said supplying toner image forming means at the non-image area on the surface of the image carrier.

Col. 19, lines 29-32, should read;
8. The image forming apparatus according to Claim 1, wherein said formation conditions of said supplying toner image is changed by changing a developing bias applying to said developing means.

Col. 19, lines 33-36, should read;
9. The image forming apparatus according to Claim 1, wherein said formation conditions of said supplying toner image is changed by changing a scanning area of said image exposing means.

Col. 19, lines 37-40, should read;
10. The image forming apparatus according to Claim 1, wherein said formation conditions of the supplying toner image is changed by changing a scanning area or an exposure intensity of said image exposing means.

UNITED STATES PATENT AND TRADEMARK OFFICE

CERTIFICATE OF CORRECTION

PATENT NO. : 6,014,530
APPLICATION NO. : 09/026427
DATED : January 11, 2000
INVENTOR(S) : Takeo Tsunemi It is certified that error appears in the above-identified patent and that said Letters Patent is hereby corrected as shown below:

Col. 19, lines 41-46, should read;
11. The image forming apparatus according to Claim 1, wherein said controller makes smaller, formation frequency, formation area size, or formation density of said supplying toner image, as the surface roughness of the image carrier is made larger, based on a measured value of said measuring means.

Col. 19, lines 53-59, should read;
13. The image forming apparatus 1-5 or 7-11, wherein said formation condition of said supplying toner image which is formed parallel to the direction of the rotation axis of the image carrier at a non-image area on the surface of the image carrier by said supplying toner image forming means is formation frequency of said supplying toner image.

Col. 19, lines 60-65, should read;
14. The image forming apparatus according to Claim 13, wherein said supplying toner image forming means operates at a normal state to form said supplying toner image and additionally operates to form said supplying toner image only at ends in the axial direction of the image carrier more frequently than the normal state.

Col. 19, 20, lines 66-5, should read;
15. The image forming apparatus according to Claims 1-5 or 7-11, wherein said formation condition of said supplying toner image which is formed parallel to the direction of the rotation axis of the image carrier at a non-image area on the surface of the image carrier by said supplying toner image forming means is formation area size of said supplying toner image.

Col. 20, lines 6-10, should read;
16. The image forming apparatus according to Claim 15, wherein said formation area size of said supplying toner image is changed by a length of said supplying toner image in a circumferential direction of the image carrier on the surface of the image carrier.

Col. 20, lines 11-16, should read;
17. The image forming apparatus according to Claim 16, wherein said formation area size of said supplying toner image is changed by forming a length in a circumferential direction at the end in an axial direction of the image carrier larger than a length in the circumferential direction at the center of the image carrier in the axial direction.

Col. 20, lines 17-21, should read;
18. The image forming apparatus according to Claim 15, wherein said formation area size of said supplying toner image is changed by a length of said supplying toner image in an axial direction of the image carrier on the surface of the image carrier.

UNITED STATES PATENT AND TRADEMARK OFFICE

CERTIFICATE OF CORRECTION

PATENT NO. : 6,014,530
APPLICATION NO. : 09/026427
DATED : January 11, 2000
INVENTOR(S) : Takeo Tsunemi It is certified that error appears in the above-identified patent and that said Letters Patent is hereby corrected as shown below:

Col. 20, lines 22-28, should read;
19. The image forming apparatus according to Claim 1-5 or 7-11, wherein said formation condition of the supplying toner image which is formed parallel to the direction of the rotation axis of the image carrier at a non-image area on the surface of the image carrier by said supplying toner image forming means is formation density of said supplying toner image.

Col. 20, lines 29-34, should read;
20. The image forming apparatus according to Claim 19, wherein die formation density of said supplying toner image is changed by rendering a formation density at the end of the image carrier in an axial direction of the carrier higher than a formation density at the center of the image carrier in the axial direction.

Col. 20, lines 35-51, should read;
21. A cleaning apparatus for cleaning surface of an image carrier comprising:
a cleaning blade member for cleaning the image carrier by contacting said image carrier;
toner supplying means for supplying toner to contacting part of said cleaning blade member and the image carrier;
detecting means for detecting a surface roughness or an information reflecting the surface roughness of the image carrier; and
controlling means for controlling supplying quantity of said toner of the toner supplying means according to a result of the detecting by said detecting means;
wherein said controlling means reduce the supplying toner quantity of said toner supplying means when said increase of the surface roughness or the information reflecting an increase of the surface roughness of the image carrier is detected by said detecting means.

Col. 20, lines 52-55; should read;
22. A cleaning apparatus according to Claim 21,
wherein said toner supplying means comprises toner image forming means for forming a supplying toner image on the image carrier,
wherein said supplying toner image is a toner image to be supplied to contacting part between said cleaning blade' member and the image carrier.

Col. 20, lines 56-58; should read;
23. A cleaning apparatus according to Claim 22, wherein said supplying toner image is a toner image which will not be transferred to the recording medium.

UNITED STATES PATENT AND TRADEMARK OFFICE

CERTIFICATE OF CORRECTION

PATENT NO. : 6,014,530
APPLICATION NO. : 09/026427
DATED : January 11, 2000
INVENTOR(S) : Takeo Tsunemi It is certified that error appears in the above-identified patent and that said Letters Patent is hereby corrected as shown below:

Col. 20, lines 59-60; should read;
24. A cleaning apparatus according to Claim 22, wherein said controlling means controls the size of said supplying toner image.

Col. 20, lines 61-64; should read;
25. A cleaning apparatus according to Claim 24, wherein said controlling means reduce the [size of said supplying toner image when an increase of the surface roughness or information reflecting an increase of the surface roughness of the image carrier is detected by said detecting means.

Col. 20, lines 65-67; should read;
26. A cleaning apparatus according to Claim 24, wherein said controlling means change a length of said supplying toner image in circumferential direction of the image carrier.

Col. 21, lines 1-3; should read;
27. A cleaning apparatus according to Claim 24, wherein said controlling means changes a length of said supplying toner image in axial direction of the image carrier.

Col. 21, lines 4-8; should read;
28. A cleaning apparatus according to Claim 22, wherein the toner forming means forms the supplying toner image at predetermined frequency and said controlling means controls the frequency of forming said supplying toner image.

Col. 21, lines 9-12; should read;
29. A cleaning apparatus according to Claim 28, wherein said controlling means reduce the frequency of said supplying toner image when an increase of the surface roughness or an information reflecting an increase of the surface roughness of the image carrier is detected by said detecting means.

Col. 21, lines 20-24; should read;
31. A cleaning apparatus according to Claim 22, wherein said controlling means rises the number of toner images recorded on recording mediums which are formed between two supplying toner images when an increase of the surface roughness or an information reflecting an increase of the surface roughness of the image carrier is detected by said detecting means.

Col. 21, lines 25-28; should read;
32. A cleaning apparatus according to Claim 22, wherein said toner supplying means comprises exposing means for exposing the image carrier, and said controlling means controls the exposing intensity of said exposing means.

UNITED STATES PATENT AND TRADEMARK OFFICE

CERTIFICATE OF CORRECTION

PATENT NO. : 6,014,530
APPLICATION NO. : 09/026427
DATED : January 11, 2000
INVENTOR(S) : Takeo Tsunemi It is certified that error appears in the above-identified patent and that said Letters Patent is hereby corrected as shown below:

Col. 21, lines 35-40; should read;
34. A cleaning apparatus according to Claim.22, wherein said toner supplying means comprises exposing means for exposing the image carrier and charging means for charging the image carrier before exposed, and said controlling means controls electric potential of said charging means.

Col. 22, lines 4-7; should read;
36. A cleaning apparatus according to Claim 21, wherein said controlling means controls toner supplying quantity supplied to an end portion of the contact part between said cleaning blade and the image carrier in an axial direction of the image carrier.

Col. 22, lines 8-12; should read;
37. A cleaning apparatus according to Claim 36, wherein said controlling means reduces the toner supplying quantity supplied to said end portion when an increase of the surface roughness of the image carrier is detected by said detecting means.

Col. 22, lines 13-15; should read;
38. A cleaning apparatus according to Claims 21, 22, 28, or 36, wherein said controlling means controls a toner supplying quantity per an area unit.

Col. 22, lines 16-19; should read;
39. A cleaning apparatus according to Claim 38, wherein said controlling means reduces the toner supplying quantity per an area unit when an increase of the surface roughness or an information reflecting an increase of the surface roughness of the image carrier is detected by said detecting means.

Col. 22, lines 20-23; should read;
40. A cleaning apparatus according to Claim 21, wherein said detecting means comprises charging means for charging the image carrier and measuring means for measuring intensity of electric current of said charging means.

Col. 22, lines 24-26; should read;
41. A cleaning apparatus according to Claim 21, wherein said detecting means comprises counting means for counting the number of rotations of the image carrier.

UNITED STATES PATENT AND TRADEMARK OFFICE

CERTIFICATE OF CORRECTION

PATENT NO. : 6,014,530
APPLICATION NO. : 09/026427
DATED : January 11, 2000
INVENTOR(S) : Takeo Tsunemi It is certified that error appears in the above-identified patent and that said Letters Patent is hereby corrected as shown below:

Col. 22, lines 27-29; should read;
42. A cleaning apparatus according to Claim 21, wherein said detecting means comprises counting means for counting the numbers of recording medium on which toner image is formed.

Col. 22, lines 30-32; should read;
43. A cleaning apparatus according to Claim 21, wherein said detecting means comprises measuring means for measuring flexibility value of said cleaning blade.

Col. 22, lines 33-35; should read;
44. A cleaning apparatus according to Claim 21, wherein said detecting means comprises measuring means for measuring vibration of said cleaning blade.

Col. 22, lines 36-39; should read;
45. A cleaning apparatus according to Claim 21, wherein a free end of said cleaning blade is disposed at upstream side of a contacting part between said cleaning blade and the image carrier in rotate direction of the image carrier.--

Signed and Sealed this

Twenty-eighth Day of November, 2006

JON W. DUDAS
*Director of the United States Patent and Trademark Office*